US011040845B2

(12) United States Patent
Walters et al.

(10) Patent No.: US 11,040,845 B2
(45) **Date of Patent: *Jun. 22, 2021**

(54) BRAKING FILM DISPENSER WITH LOBES

(71) Applicant: Pratt Corrugated Holdings, Inc., Conyers, GA (US)

(72) Inventors: Travis Walters, Atlanta, GA (US); Gregg McPheely, Atlanta, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 190 days.

This patent is subject to a terminal disclaimer.

(21) Appl. No.: 16/365,730

(22) Filed: Mar. 27, 2019

(65) Prior Publication Data

US 2019/0218050 A1 Jul. 18, 2019

Related U.S. Application Data

(63) Continuation of application No. 15/454,415, filed on Mar. 9, 2017, now Pat. No. 10,287,122.

(51) Int. Cl.

| | |
|---|---|
| ***B65H 16/00*** | (2006.01) |
| ***B65B 67/08*** | (2006.01) |
| ***B65H 75/30*** | (2006.01) |

(52) U.S. Cl.

CPC ..... *B65H 16/005* (2013.01); *B65B 67/085* (2013.01); *B65H 75/30* (2013.01); *B65H 2402/412* (2013.01); *B65H 2701/1944* (2013.01)

(58) Field of Classification Search

CPC .. B65H 16/005; B65H 75/30; B65H 2405/40; B65H 2701/1944; B65B 67/085

See application file for complete search history.

(56) References Cited

U.S. PATENT DOCUMENTS

| | | | |
|---|---|---|---|
| 1,364,259 | A | 1/1921 | Eaton |
| 1,451,914 | A | 4/1923 | Kongsrud |

(Continued)

FOREIGN PATENT DOCUMENTS

| | | |
|---|---|---|
| DE | 1924348 | 11/1970 |
| DE | 202004011730 | 11/2004 |

(Continued)

OTHER PUBLICATIONS

Dahlmann, Deborah A.; Notice of Allowance for U.S. Appl. No. 16/135,743, filed Sep. 19, 2018, dated Sep. 23, 2019, 19 pgs.

(Continued)

*Primary Examiner* — Michael R Mansen
*Assistant Examiner* — Mark K Buse
(74) *Attorney, Agent, or Firm* — Taylor English Duma LLP

(57) ABSTRACT

A film dispenser includes a holding member and a rotating member, the holding member including a first end including a handle, the handle including a plurality of lobes and a plurality of web portions, each web portion extending between a pair of adjacent lobes of the plurality of lobes; and a second end defining a brake portion defined by a slot, the holding member defining a longitudinal axis that extends from the first end to the second end, the slot including a first portion extending in a circumferential direction across a full width of the brake portion and two opposing portions extending at an angle from the first portion; each of the plurality of web portions extending outward beyond an outermost edge of the rotating member relative to the longitudinal axis.

20 Claims, 15 Drawing Sheets

(56) References Cited

U.S. PATENT DOCUMENTS 1,935,392 A 11/1933 Coninck
2,331,743 A 10/1943 Sullivan
3,856,229 A 12/1974 Bryam
4,102,513 A 7/1978 Guard
4,166,589 A 9/1979 Hoover et al.
4,179,081 A 12/1979 Parry
4,226,380 A 10/1980 Gay
4,248,392 A 2/1981 Parry
4,339,022 A 7/1982 Hoover
4,372,500 A 2/1983 Saraisky
D268,514 S 4/1983 Thompson
4,477,037 A 10/1984 Goldstein
4,484,717 A 11/1984 Goldstein
4,530,473 A 7/1985 Parry
4,575,020 A 3/1986 Strout et al.
4,600,163 A 7/1986 Hummel et al.
4,659,031 A 4/1987 Saraisky
4,706,442 A 11/1987 Riemenschneider
4,722,493 A 2/1988 Parry et al.
4,752,045 A 6/1988 Goldstein
4,784,348 A 11/1988 McDonald
4,817,762 A 4/1989 Powell
4,834,312 A 5/1989 Riemenschneider, III
4,872,623 A 10/1989 Parry et al.
4,874,139 A 10/1989 Kewin
4,971,265 A 11/1990 Koch
5,094,395 A 3/1992 Lambert
5,135,179 A 8/1992 Morano
5,150,852 A 9/1992 Hunt et al.
5,186,376 A 2/1993 Scharf et al.
5,190,237 A 3/1993 Fagan
5,203,517 A 4/1993 Parry et al.
5,310,074 A * 5/1994 Jochem ..... B65D 50/04 215/223
5,351,905 A 10/1994 Ferber
5,398,884 A 3/1995 Stanford
5,409,177 A 4/1995 Parry et al.
5,453,152 A 9/1995 Mazzola et al.
5,490,642 A 2/1996 Schwartz et al.
D371,298 S 7/1996 Reddy et al.
5,573,630 A 11/1996 Edney et al.
5,664,739 A 9/1997 Black et al.
5,868,334 A 2/1999 Cedillo
5,915,642 A 6/1999 Davis
5,927,635 A 7/1999 Black et al.
5,938,142 A 8/1999 Halperin
5,961,063 A * 10/1999 Parry ..... B65H 16/005 242/422.4
6,015,111 A 1/2000 Berke
6,019,308 A 2/2000 Huang
6,027,069 A * 2/2000 Huang ..... B65B 67/085 242/588.2
D424,341 S 5/2000 Anderberg
D425,347 S 5/2000 Anderberg
6,102,323 A 8/2000 Riemenschneider
6,227,479 B1 5/2001 Dean et al.
6,227,480 B1 * 5/2001 Huang ..... B65H 35/0026 242/588.2
6,398,150 B1 6/2002 Munter et al.
6,422,499 B1 * 7/2002 Bernard ..... A01K 89/0111 242/322
6,491,252 B2 12/2002 Komatsu et al.
6,508,430 B1 1/2003 Rodriguez
6,517,023 B2 2/2003 Rodriguez
6,651,918 B2 * 11/2003 Huang ..... B65B 67/085 242/423.1
6,676,069 B1 1/2004 Davis
6,739,542 B1 5/2004 Prina et al.
6,883,298 B2 4/2005 Gooding et al.
6,892,975 B2 * 5/2005 Yu Chen ..... B65B 67/08 242/422.4
6,905,045 B2 6/2005 Yu Chen
6,926,225 B1 8/2005 Powers
6,997,411 B2 2/2006 Kewin
7,017,743 B1 3/2006 Patterson
7,210,649 B2 * 5/2007 Yu Chen ..... B65D 85/02 242/405.3
7,380,744 B1 6/2008 Yu Chen
7,401,449 B2 7/2008 Watson et al.
7,438,254 B2 10/2008 Oettershagen
D593,464 S 6/2009 Mentis
7,543,426 B1 6/2009 Phero
7,552,891 B2 * 6/2009 Huang ..... B65B 67/085 242/405.3
7,665,686 B2 2/2010 Becker et al.
D612,179 S 3/2010 Huang
7,726,600 B2 * 6/2010 Huang ..... B65H 75/24 242/588.2
7,762,490 B1 7/2010 Yu Chen
7,866,596 B2 1/2011 Yamada
7,900,421 B2 3/2011 Smith
7,937,915 B2 5/2011 Kohn et al.
D649,570 S 11/2011 Chen
8,104,705 B2 1/2012 Yu Chen
8,308,102 B2 11/2012 Lin
8,317,124 B2 11/2012 Yu Chen
8,468,778 B2 6/2013 Windheuser
8,578,683 B2 11/2013 Smith
8,616,490 B2 12/2013 Blok
8,622,332 B2 1/2014 Bologna
8,708,267 B2 4/2014 Morgan
8,783,428 B2 7/2014 Beri
9,010,675 B2 4/2015 Harrison
D738,414 S 9/2015 Chen
9,272,870 B2 * 3/2016 Stanton ..... B65H 75/406
9,284,085 B2 3/2016 Pace
9,481,536 B2 11/2016 Sager et al.
9,688,507 B2 * 6/2017 Stanton ..... B65H 75/406
9,731,932 B2 8/2017 Sager et al.
9,802,722 B1 10/2017 Bison
D810,797 S 2/2018 Love et al.
9,908,656 B2 3/2018 Dahlmann et al.
9,926,093 B2 3/2018 Chen
9,950,896 B2 4/2018 Stanton
9,988,171 B2 * 6/2018 Dahlmann ..... B65H 16/005
D823,905 S * 7/2018 Walters ..... D15/135
10,087,037 B2 10/2018 Sager et al.
D832,899 S * 11/2018 Walters ..... D15/135
D833,492 S 11/2018 Stevens et al.
10,150,639 B2 12/2018 Dahlmann et al.
D844,037 S 3/2019 Stevens et al.
10,280,036 B2 5/2019 Stanton
10,287,122 B2 * 5/2019 Walters ..... B65H 16/005
10,494,213 B2 12/2019 Dahlmann et al.
2001/0032904 A1 * 10/2001 Liu ..... B65H 75/242 242/571.4
2002/0070310 A1 * 6/2002 Liu ..... B65H 75/185 242/571.4
2003/0132336 A1 7/2003 Huang
2003/0141406 A1 * 7/2003 Liu ..... B65H 75/185 242/571.4
2004/0065577 A1 * 4/2004 Yu Chen ..... B65H 23/06 206/497
2004/0084559 A1 * 5/2004 Fraser ..... B65H 23/063 242/422.4
2004/0134820 A1 7/2004 Katayama
2004/0245282 A1 12/2004 Yu Chen
2005/0124476 A1 6/2005 Kuhl
2005/0168047 A1 * 8/2005 Grier ..... B60P 1/56 298/27
2006/0032965 A1 2/2006 Yu Chen
2006/0071118 A1 4/2006 Offerhaus
2006/0175460 A1 * 8/2006 Hua ..... B65H 16/06 242/579
2006/0237577 A1 10/2006 Chen
2006/0278751 A1 12/2006 Chen
2007/0045465 A1 * 3/2007 Oettershagen ..... B65B 67/085 242/599.3
2007/0063092 A1 3/2007 Zevin et al.
2007/0151208 A1 7/2007 Huang
2008/0072538 A1 3/2008 Kohn et al.
2008/0258002 A1 10/2008 Migliaccio

(56) References Cited

U.S. PATENT DOCUMENTS

| | | | | |
|---|---|---|---|---|
| 2009/0044494 | A1 | 2/2009 | Northrup | |
| 2009/0127372 | A1 | 5/2009 | Saraisky | |
| 2009/0308968 | A1 | 12/2009 | Piotrowski et al. | |
| 2010/0044491 | A1 | 2/2010 | Ritchey et al. | |
| 2011/0095122 | A1 | 4/2011 | Yu Chen | |
| 2011/0233321 | A1 | 9/2011 | Yu Chen | |
| 2011/0284680 | A1 | 11/2011 | Lin | |
| 2012/0153063 | A1 | 6/2012 | Furuichi | |
| 2012/0181369 | A1 | 7/2012 | Blok | |
| 2013/0152384 | A1 | 6/2013 | Yu Chen | |
| 2014/0110616 | A1* | 4/2014 | Freeth | F16K 35/027 251/288 |
| 2014/0116004 | A1 | 5/2014 | Pace | |
| 2014/0188020 | A1 | 7/2014 | Joseph | |
| 2015/0166285 | A1* | 6/2015 | Stanton | B65H 75/185 242/422 |
| 2016/0137454 | A1 | 5/2016 | Stanton | |
| 2016/0221704 | A1 | 8/2016 | Dahlmann | |
| 2016/0264277 | A1 | 9/2016 | Dahlmann | |
| 2016/0355293 | A1 | 12/2016 | Clarke | |
| 2017/0137160 | A1* | 5/2017 | Yu Chen | B65H 23/06 |
| 2017/0260020 | A1 | 9/2017 | Stanton | |
| 2017/0305621 | A1 | 10/2017 | Miller | |
| 2018/0022565 | A1 | 1/2018 | Dahlmann et al. | |
| 2018/0194590 | A1 | 7/2018 | Stanton | |
| 2018/0257889 | A1 | 9/2018 | Walters et al. | |
| 2019/0016549 | A1 | 1/2019 | Dahlmann et al. | |

FOREIGN PATENT DOCUMENTS

| | | |
|---|---|---|
| EP | 0030572 | 6/1981 |
| EP | 0227564 | 7/1987 |
| EP | 0310291 | 4/1989 |
| EP | 0499761 | 8/1992 |
| FR | 2588841 | 5/1988 |
| FR | 2910887 | 12/2009 |
| GB | 2055345 | 3/1981 |
| GB | 2289039 | 11/1995 |
| GB | 2299321 | 10/1996 |
| GB | 2456801 | 7/2009 |
| GB | 2478933 | 9/2011 |
| JP | H0769349 | 3/1995 |
| TW | 201026567 | 7/2010 |
| WO | 1993010006 | 5/1993 |
| WO | 1995000395 | 1/1995 |
| WO | 2007066194 | 6/2007 |

OTHER PUBLICATIONS

Dahlmann, Deborah A.; Supplemental Notice of Allowance for U.S. Appl. No. 16/135,743, filed Sep. 19, 2018, dated Oct. 17, 2019, 6 pgs.

amazon.com; Article entitled: "Goodwrappers VSR PRD15005 Linear Low Density Polyethylene Clear Cast Hand Stretch Wrap with 1 Reusable Dispenser and Hand Brake, 650' Length x 5" Width x 150 Gauge Thick (Case of 12)", publicly available prior to Apr. 12, 2019, 5 pgs.

American Paper & Twine Co.; Article entitled: Classic Films Hand Stretch Banding Bundling Film, publicly available prior to Apr. 12, 2019, 2 pgs.

Medwest Inc; Article entitled: "Flex-i-Wrap", publicly available prior to Apr. 12, 2019, 4 pgs.

Mipaq; Article entitled: "W810—Hand wrap dispenser for 100mm Stretch Wrap", publicly available prior to Apr. 12, 2019, 2 pgs.

walmart.com; Article entitled: "Hand Stretch Wrap, Red, 1000 ft. L, 3 in W, PK415A903", publicly available prior to Apr. 12, 2019, 5 pgs.

Stanton, Christopher M.; Issue Notification for U.S. Appl. No. 14/108,881, filed Dec. 17, 2013, dated Feb. 10, 2016, 1 pg.

Stanton, Christopher M.; Non-Final Office Action for U.S. Appl. No. 14/108,881, filed Dec. 17, 2013, dated Sep. 23, 2015, 29 pgs.

Stanton, Christopher M.; Notice of Allowance for U.S. Appl. No. 14/108,881, filed Dec. 17, 2013, dated Nov. 24, 2015, 5 pgs.

Stanton, Christopher M..; Non-Final Office Action for U.S. Appl. No. 15/001,281, filed Jan. 20, 2016, dated Jan. 11, 2017, 44 pgs.

Stanton, Christopher M.; Issue Notification for U.S. Appl. No. 15/001,281, filed Jan. 20, 2016, dated Jun. 7, 2017, 1 page.

Stanton, Christopher M.; Notice of Allowability for U.S. Appl. No. 15/001,281, filed Jan. 20, 2016, dated Apr. 26, 2017, 6 pgs.

Stanton, Christopher M.; Notice of Allowance for U.S. Appl. No. 15/001,281, filed Jan. 20, 2016, dated Mar. 8, 2017, 5 pgs.

Stanton, Christopher M.; Issue Notification for U.S. Appl. No. 15/606,361, filed May 26, 2017, dated Apr. 4, 2018, 1 pg.

Stanton, Christopher M.; Notice of Allowance for U.S. Appl. No. 15/606,361, filed May 26, 2017, dated Dec. 14, 2017, 30 pgs.

Stanton, Christopher M.; Supplemental Notice of Allowance for U.S. Appl. No. 15/606,361, filed May 26, 2017, dated Jan. 16, 2018, 6 pgs.

Stanton, Christopher M.; Supplemental Notice of Allowance for U.S. Appl. No. 15/606,361, filed May 26, 2017, dated Dec. 28, 2017, 4 pgs.

Stanton, Christopher M.; Supplemental Notice of Allowance for U.S. Appl. No. 15/606,361, filed May 26, 2017, dated Mar. 22, 2018, 6 pgs.

Stanton, Christopher M.; Issue Notification for U.S. Appl. No. 15/916,992, filed Mar. 9, 2018, dated Apr. 17, 2019, 1 pg.

Stanton, Christopher M.; Non-Final Office Action for U.S. Appl. No. 15/916,992, filed Mar. 9, 2018, dated May 16, 2018, 25 pgs.

Stanton, Christopher M.; Notice of Allowance for U.S. Appl. No. 15/916,992, filed Mar. 9, 2018, dated Nov. 1, 2018, 16 pgs.

Stanton, Christopher M.; Supplemental Notice of Allowance for U.S. Appl. No. 15/916,992, filed Mar. 9, 2018, dated Nov. 21, 2018.

Stanton, Christopher M.; Supplemental Notice of Allowance for U.S. Appl. No. 15/916,992, filed Mar. 9, 2018, dated Nov. 8, 2018, 2 pgs.

Dahlmann, Deborah A.; Advisory Action for U.S. Appl. No. 14/609,567, filed Jan. 30, 2015, dated Jan. 24, 2017, 4 pgs.

Dahlmann, Deborah A.; Final Office Action for U.S Appl. No. 14/609,567, filed Jan. 30, 2015, dated Oct. 20, 2016; 11 pgs.

Dahlmann, Deborah A.; Issue Notification for U.S. Appl. No. 14/609,567, filed Jan. 30, 2015, dated Feb. 14, 2018, 1 pg.

Dahlmann, Deborah A.; Non-Final Office Action for U.S. Appl. No. 14/609,567, filed Jan. 30, 2015, dated Mar. 16, 2016, 38 pgs.

Dahlmann, Deborah A.; Notice of Allowance for U.S. Appl. No. 14/609,567, filed Jan. 30, 2015, dated Jul. 6, 2017, 17 pgs.

Dahlmann, Deborah A.; Issue Notification for U.S. Appl. No. 14/642,940, filed Mar. 10, 2015, dated May 16, 2018, 1 pg.

Dahlmann, Deborah A.; Non-Final Office Action for U.S. Appl. No. 14/642,940, filed Mar. 10, 2015, dated Oct. 11, 2017, 48 pgs.

Dahlmann, Deborah A.; Notice of Allowance for U.S. Appl. No. 14/642,940, filed Mar. 10, 2015, dated Apr. 2, 2018, 9 pgs.

Dahlmann, Deborah A.; Supplemental Notice of Allowance for U.S. Appl. No. 14/642,940, filed Mar. 10, 2015, dated Apr. 13, 2018, 6 pgs.

Dahlmann, Deborah; Supplemental Notice of Allowance for U.S. Appl. No. 14/642,940, filed Mar. 10, 2015, dated May 9, 2018, 6 pgs.

Dahlmann, Deborah A.; Issue Notification for U.S. Appl. No. 15/215,025, filed Jul. 20, 2016, dated Oct. 10, 2018, 1 pg.

Dahlmann, Deborah A.; Issue Notification for U.S. Appl. No. 15/215,025, filed Jul. 20, 2016, dated Nov. 20, 2018, 1 pg.

Dahlmann, Deborah A.; Supplemental Notice of Allowance for U.S. Appl. No. 15/215,025, filed Jul. 20, 2016, dated Aug. 29, 2018, 6 pgs.

Dahlmann, Deborah A.; Supplemental Notice of Allowance for U.S. Appl. No. 15/215,025, filed Jul. 20, 2016, dated Sep. 27, 2018, 6 pgs.

Dahlmann, Deborah; Non-Final Office Action for U.S. Appl. No. 15/215,025, filed Jul. 20, 2016, dated Apr. 30, 2018, 49 pgs.

Dahlmann, Deborah; Notice of Allowance for U.S. Appl. No. 15/215,025, filed Jul. 20, 2016, dated Jun. 26, 2018, 10 pgs.

Dahlmann, Deborah; Supplemental Notice of Allowance for U.S. Appl. No. 15/215,025, filed Jul. 20, 2016, dated Nov. 6, 2018, 7 pgs.

(56) References Cited

OTHER PUBLICATIONS

Dahlmann, Deborah A.; Non-Final Office Action for U.S. Appl. No. 16/135,743, filed Sep. 19, 2018, dated Oct. 30, 2018, 28 pgs.
Walters, Travis; Issue Notification for U.S. Appl. No. 15/454,415, filed Mar. 9, 2017, dated Apr. 24, 2019, 1 pg.
Walters, Travis; Non-Final Office Action for U.S. Appl. No. 15/454,415, filed Mar. 9, 2017, dated Oct. 5, 2018, 52 pgs.
Walters, Travis; Notice of Allowance for U.S. Appl. No. 15/454,415, filed Mar. 9, 2017, dated Jan. 7, 2019, 12 pgs.
Walters, Travis; Supplemental Notice of Allowance for U.S. Appl. No. 15/454,415, filed Mar. 9, 2017, dated Feb. 22, 2019, 6 pgs.
Walters, Travis; Issue Notification for Design U.S. Appl. No. 29/596,584, filed Mar. 9, 2017, dated Jul. 4, 2018, 1 pg.
Walters, Travis; Notice of Allowance for U.S. Appl. No. 29/596,584, filed Mar. 9, 2017, dated May 7, 2018, 40 pgs.
Walters, Travis; Supplemental Notice of Allowability for Design U.S. Appl. No. 29/596,584, filed Mar. 9, 2017, dated Jun. 25, 2018, 8 pgs.
Walters, Travis; Issue Notification for U.S. Appl. No. 29/649,781, filed Jun. 1, 2018, dated Oct. 17, 2018, 1 pg.
Walters, Travis; Notice of Allowance for a Design Application for Design U.S. Appl. No. 29/649,781, filed Jun. 1, 2018, dated Aug. 31, 2018, 29 pgs.
Walters, Travis; Supplemental Notice of Allowance for Design U.S. Appl. No. 29/649,781, filed Jun. 1, 2018, dated Sep. 24, 2018, 7 pgs.
Walters, Travis; Supplemental Notice of Allowance for U.S. Appl. No. 29/649,781, filed Jun. 1, 2018, dated Sep. 10, 2018, 3 pgs.
"Hand Savers Stretch Wrap Film Hand Dispenser" www.ebay.com http://www.ebay.com/itm/Hand-Savers-Stretch-Wrap-Film-Hand-Dispenser-1-set-/251286375179 (Accessed Jun. 10, 2013), 3 pgs.
"Stretch film—BK Holder" www.benkaico.com http://www.benkaico.com/product-area/stretch-film—bk-holder (Accessed Jun. 10, 2013), 2 pgs.
"Stretch Film Dispenser—Hand Core Insert 3" www.aaabalingandstrapping.com http://www.aaabalingandstrapping.com/index.php?main_page=product_info&cPath=8&products_id=183&zenid=3tkfdrfajbi8ha9ducbdvfclv4 (Accessed Jun. 10, 2013), 2 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp>, 4 pgs.
Images of Braking Wrap Film Dispenser, the Dispenser publicly available prior to Dec. 17, 2012, 12 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.

* cited by examiner

BRAKING FILM DISPENSER WITH LOBES

REFERENCE TO RELATED APPLICATIONS

This application is a continuation of U.S. application Ser. No. 15/454,415, filed Mar. 9, 2017, which is hereby specifically incorporated by reference herein in its entirety.

TECHNICAL FIELD

Field of Use

This disclosure relates to film dispensers. More specifically, this disclosure relates to braking film dispensers that allow rolls of material to be ergonomically dispensed with adjustable tension.

Related Art

Just as a plastic film can be rolled up on a cardboard or paperboard core member and then dispensed as a moisture-proof wrapping for food by unrolling the material onto food placed on or inside a dish, sheets of material can be used to wrap goods. For example, the plastic film, membrane, or sheet of any suitable material is often rolled up on cylindrical cardboard or paperboard core member or other similar device such as a spool or roll made of another material that allows the film or sheet to be dispensed to facilitate the wrapping of goods. This can protect the goods from dust, water, and other contaminants found in their environment. In many situations, the dispensing from such a film roll is done manually. Especially for one-time or disposable use by a consumer, the spools or tools conventionally used to dispense the film or sheet can been prohibitively expensive and can be heavy and therefore difficult to handle, and the mechanism used to create tension in the film can be difficult to use and adjust.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a film dispenser comprising a holding member, the holding member comprising: a first end comprising a handle, the handle comprising a plurality of lobes; and a second end defining a brake portion defined by a slot, the holding member defining a longitudinal axis that extends from the first end to the second end, the slot comprising a first portion extending in a circumferential direction across a full width of the brake portion and two opposing portions extending at an angle from the first portion.

Also disclosed is a film dispenser comprising a holding member, the holding member comprising: a first end comprising a handle, the handle comprising a plurality of lobes; a second end defining a brake portion defining a slot, the holding member defining a longitudinal axis that extends from the first end to the second end, a center of the brake portion positioned circumferentially between a pair of adjacent lobes of the plurality of lobes relative to the longitudinal axis; and a connecting portion extending radially inward from the brake portion.

Also disclosed is a method of dispensing material from a film roll using a film dispenser, the method comprising: holding onto an interior holding surface and an exterior holding surface of a holding member of the film dispenser with one hand such that a portion of the hand is positioned between a pair of adjacent lobes of a plurality of lobes of the holding member, the holding member comprising a first end comprising the interior holding surface and the plurality of lobes defining the exterior holding surface; and a second end comprising a brake portion; wherein the second end of the holding member is inserted into an opening defined in the first end of the film roll; dispensing the material by rotating the film roll relative to the holding member; and pressing onto the brake portion to increase the tension in or stretch the material being dispensed.

Also disclosed is a film dispenser comprising: a holding member comprising: a first end comprising a handle, the handle comprising a plurality of lobes and a plurality of web portions, each web portion extending between a pair of adjacent lobes of the plurality of lobes; and a second end defining a brake portion defined by a slot, the holding member defining a longitudinal axis that extends from the first end to the second end, the slot comprising a first portion extending in a circumferential direction across a full width of the brake portion and two opposing portions extending at an angle from the first portion; and a rotating member, each of the plurality of web portions extending outward beyond an outermost edge of the rotating member relative to the longitudinal axis.

Also disclosed is a film dispenser comprising: a holding member comprising: a first end comprising a handle, the handle comprising a plurality of lobes and a plurality of web portions, each web portion extending between a pair of adjacent lobes of the plurality of lobes; a second end defining a brake portion defining a slot, the holding member defining a longitudinal axis that extends from the first end to the second end; and a connecting portion extending radially inward from the brake portion; and a rotating member, each of the plurality of web portions extending outward beyond an outermost edge of the rotating member relative to the longitudinal axis.

Also disclosed is a method of dispensing material from a film roll using a film dispenser, the method comprising: holding onto an interior holding surface and an exterior holding surface of a first holding member of the film dispenser with a first hand, the first holding member comprising a first end comprising the interior holding surface, a plurality of lobes and a plurality of web portions, each web portion extending between a pair of adjacent lobes of the plurality of lobes, the plurality of lobes and the plurality of web portions defining the exterior holding surface; and a second end comprising a brake portion; wherein the second end of the first holding member is inserted into a first rotating member inserted into an opening defined in the first end of the film roll; holding onto an interior holding surface and an exterior holding surface of a second holding member of the film dispenser with a second hand, the second holding member comprising a first end comprising the interior holding surface of the second holding member, a plurality of lobes and a plurality of web portions, each web portion of the second holding member extending between a pair of adjacent lobes of the plurality of lobes of the second holding member, the plurality of lobes of the second holding member and the plurality of web portions of the second holding member defining the exterior holding surface of the second holding member; and a second end comprising a brake portion; wherein the second end of the second holding member is inserted into a second rotating member inserted into an opening defined in the second end of the film roll; dispensing the material by rotating the film roll relative to the first holding member and the second holding member; and pressing onto the brake portion of one of the first holding member and the second holding member such that the brake portion brakes movement of the one of the first holding member and the second holding member into the corresponding rotating member to increase the tension in or stretch the material being dispensed.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

DESCRIPTION OF THE FIGURES

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
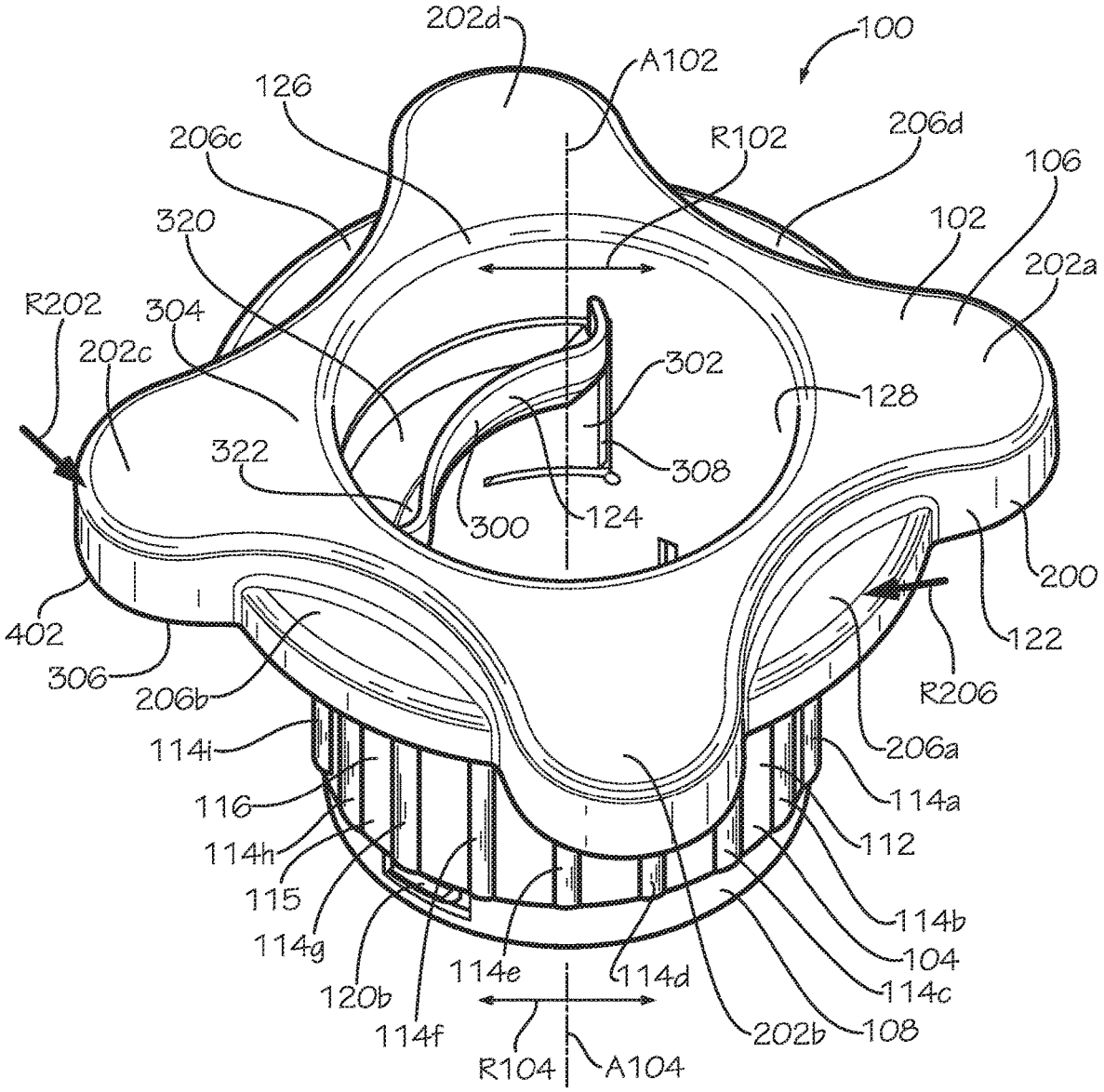
FIG. 1 is a perspective view of a film dispenser according to a first aspect of the present disclosure including a holding member and a rotating member.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

In one aspect, a film dispenser and associated methods, systems, devices, and various apparatuses are disclosed herein. In one aspect, the film dispenser can comprise a holding member. In another aspect, a rotating member can be joined to the holding member in a rotatable fashion along a common longitudinal axis so that the rotating member may rotate with a spool of wrap or film while the user comfortable holds the holding member. The term "holding member" should be interpreted broadly and should be applied to any member that can be held in a user's hand and that can allow rotation of the rotating member or a film roll about the longitudinal axis of the holding member. The term "rotating member" should be interpreted broadly and should be applied to any member that can rotate relative to the holding member and thereby facilitate dispensing of the film. While the film dispenser can be particularly useful in applications for dispensing plastic film, sheets, or wrap, it can be used with any other dispensable material, such as cloth or metal, of any desired thickness that is used to enclose, enwrap, cover, or otherwise protect articles. It would be understood by one of skill in the art that the disclosed film dispenser is described in but a few exemplary aspects among many. No particular terminology or description should be considered on the disclosure or the scope of any claims issuing therefrom.

As shown in FIG. 1, a film dispenser 100 can comprise a holding member 102. The film dispenser 100 can also comprise a rotating member 104. The holding member 102 and the rotating member 104 can be of a substantially annular or tubular configuration and can be formed as separate components. The holding member 102 can define a longitudinal axis A102 extending from its first end 106 to its second end 108. The holding member 102 can also define a radial direction R102 extending from and about the longitudinal axis A102.

The rotating member 104 can comprise a sleeve 115 and define an axis of rotation A104 extending from its first end 110 (shown in FIG. 7) to its second end 112. The rotating member 104 can comprise a plurality of ridges or ribs 114. Nine ridges 114*a* thru 114*i* are shown in FIG. 1. In various aspects, as many as eighteen ridges 114 can be used, each of which can be evenly spaced around the periphery. In yet another aspect, any number of ribs 114 can be used including a single rib or a plurality of ribs—including more than eighteen in total, each of which need not be evenly placed about the periphery of the rotating member. Each of the ribs 114 can be placed on an exterior surface 116 of the second end 112 of the rotating member 104 and can be configured to engage an inner bore of a film roll 902 (shown in FIG. 12), which can be a spool or hollow cardboard core of stretch wrap film, other film, or other material 910 (shown in FIG. 13).

The rotating member 104 can also comprise an annular flange 118 (shown in FIG. 7), which can contact the holding member 102 at its first end 106 or nearly so when the holding member 102 is assembled to the rotating member 104. The flange 118 can define a thickness along the axis of rotation A104 and can extend annularly in a direction that is perpendicular to the axis of rotation A104. The rotating member 104 can thus be trapped or captured between a snap 120*a,b* (120*a* shown in FIG. 4) of the holding member 102, which can be a lever arm, and the first end 106 of the holding member 102, allowing the rotating member 104 to rotate freely about but not move by any significant amount lengthwise along the longitudinal axis A102 of the holding member 102. The rotating member 104 also can define a radial direction R104 extending from and about the axis of rotation A104.

When assembled as shown, the axis of rotation A104 of the rotating member 104 and the longitudinal axis A102 of the holding member 102 can be aligned or made coextensive, or nearly so, allowing the user to hold onto the holding member 102 while the film roll 902 and the rotating member 104 turn, allowing the material 910 to be dispensed. It should be noted that some clearance can be provided between the holding member 102 and the rotating member 104 in both the radial and longitudinal directions so that that the rotating member 104 can freely rotate. The amount of clearance can range from, for example and without limitation, 0.005 to 0.025 inches on a side.

Also shown in FIG. 1, the holding member 102 can comprise a brake portion 302, a rail 124, and a connecting portion 320 connecting the brake portion 302 and the rail 124. In one aspect, a transition portion 322 can join the rail 124 and the connecting portion 320. In another aspect, the rail 124 and the connecting portion 320 can be joined directly to one another. The brake portion can at least in part be defined by a slot 308. The first end 106 of the holding member 102 can define an exterior holding surface 122. A one of the first end 106 and the second end 108 of the holding member 102 can define an interior holding surface 300, which more specifically can be defined on a back side of the rail 124. The holding member 102 can be configured such that a portion of the palm of the hand of a user as well as a portion of the thumb as desired can be placed against the exterior holding surface 122 while the interior of the fingers can be placed against the interior holding surface 300 (as shown in FIG. 14B). Thus, the holding member 102 can provide an ergonomic handle for the user to hold onto as the film dispenser 100 is used to dispense the material 910. The interior holding surface 300 can comprise a concave surface facing the longitudinal axis A102 of the holding member 102.

Figure 7:
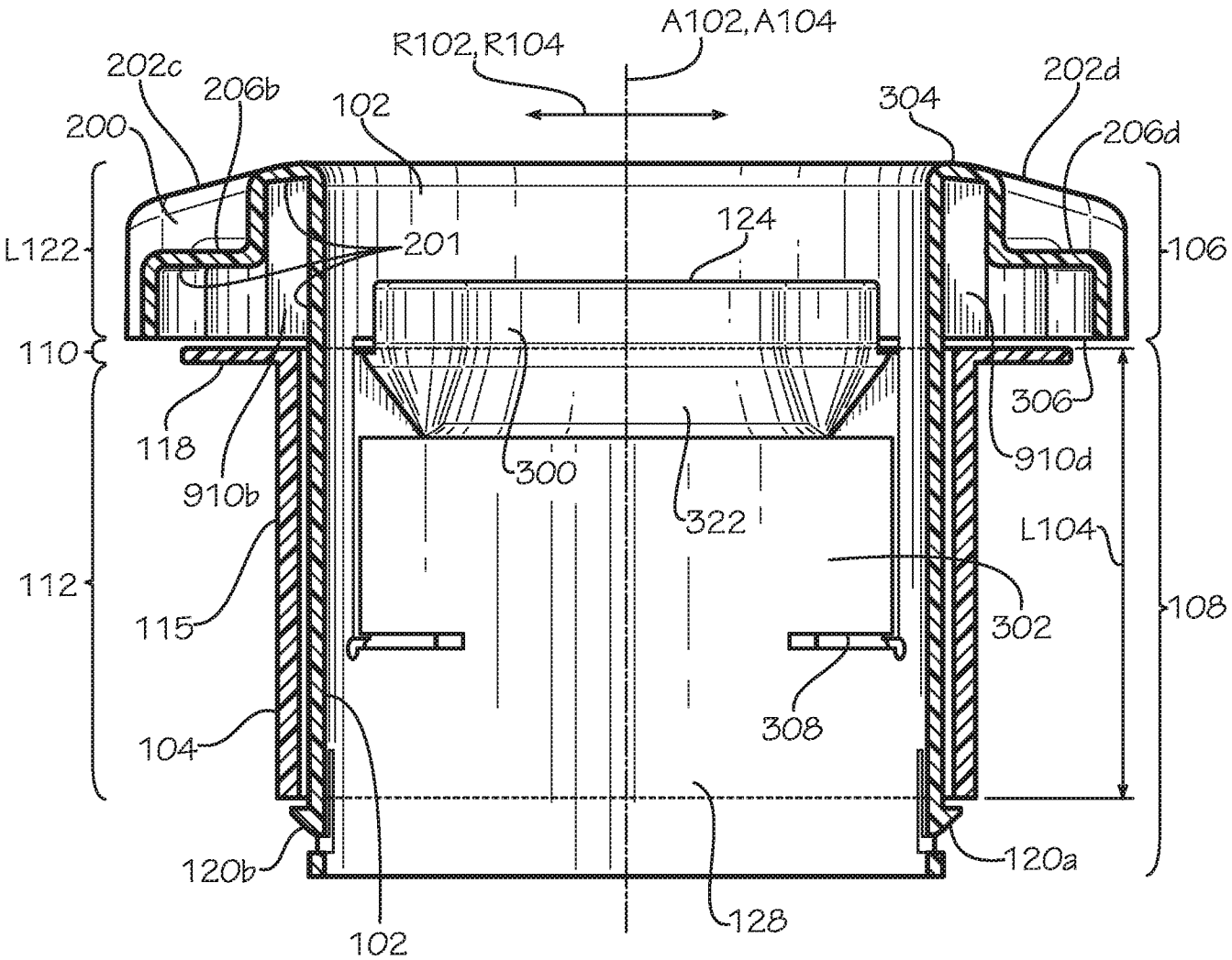
FIG. 7 is a sectional view of the holding member of FIG. 2 taken from line 7-7 of FIG. 5.

As shown, the first end 106 of the holding member 102 can comprise a handle 200 comprising a plurality of lobes 202*a,b,c,d*. Each of the plurality of lobes 202*a,b,c,d* can extend outward in a radial direction along the radial direction R102 of the holding member 102. Each of the plurality of lobes 202*a,b,c,d* can be positioned between an outside extremity 304 and an inside extremity 306 of the holding member 102 along a direction of the longitudinal axis A102. In one aspect, the holding member 102 can comprise four lobes 202*a,b,c,d*. In another aspect, the holding member 102 can comprise only one, two, or three lobes 202. In yet another aspect, the holding member 102 can comprise more than four lobes 202. As shown in FIG. 7, each of the plurality of lobes 202 can extend outward beyond a radially outermost edge of the rotating member 104 relative to the longitudinal axis A102. A handle edge 402 can be defined by an intersection between the exterior holding surface 122 and the inside extremity 306 of the holding member 102.

The holding member 102 can further comprise a plurality of web portions 206*a,b,c,d*. Each web portion 206*a,b,c,d* can extend between a pair of adjacent lobes 202*a,b,c,d* of the plurality of lobes 202*a,b,c,d*. In one aspect, the holding member 102 can comprise four web portion 206*a,b,c,d*. In another aspect, the holding member 102 can comprise only one, two, or three web portions 206; or the holding member 102 can comprise more than four web portions 206. As shown, the web portions 206*a,b,c,d* can together define a round or circular, cylindrical, or other shape that is concentric with the longitudinal axis A102. As shown in FIG. 7, each of the plurality of web portions 206 can extend outward beyond a radially outermost edge of the rotating member 104 relative to the longitudinal axis A102. In one aspect, the number of lobes 202 can be equal to the number of web portions 206.

In one aspect, the first end 106 of the holding member 102 can comprise a blend 126, which can be a chamfered or radiused edge, extending along a portion of the circumference or a full circumference of a central hole 128 of the holding member 102. The blend 126 can help provide a lead-in as a user inserts a hand into the central hole 128 for grasping onto or gripping the holding member 102.

Figure 2:
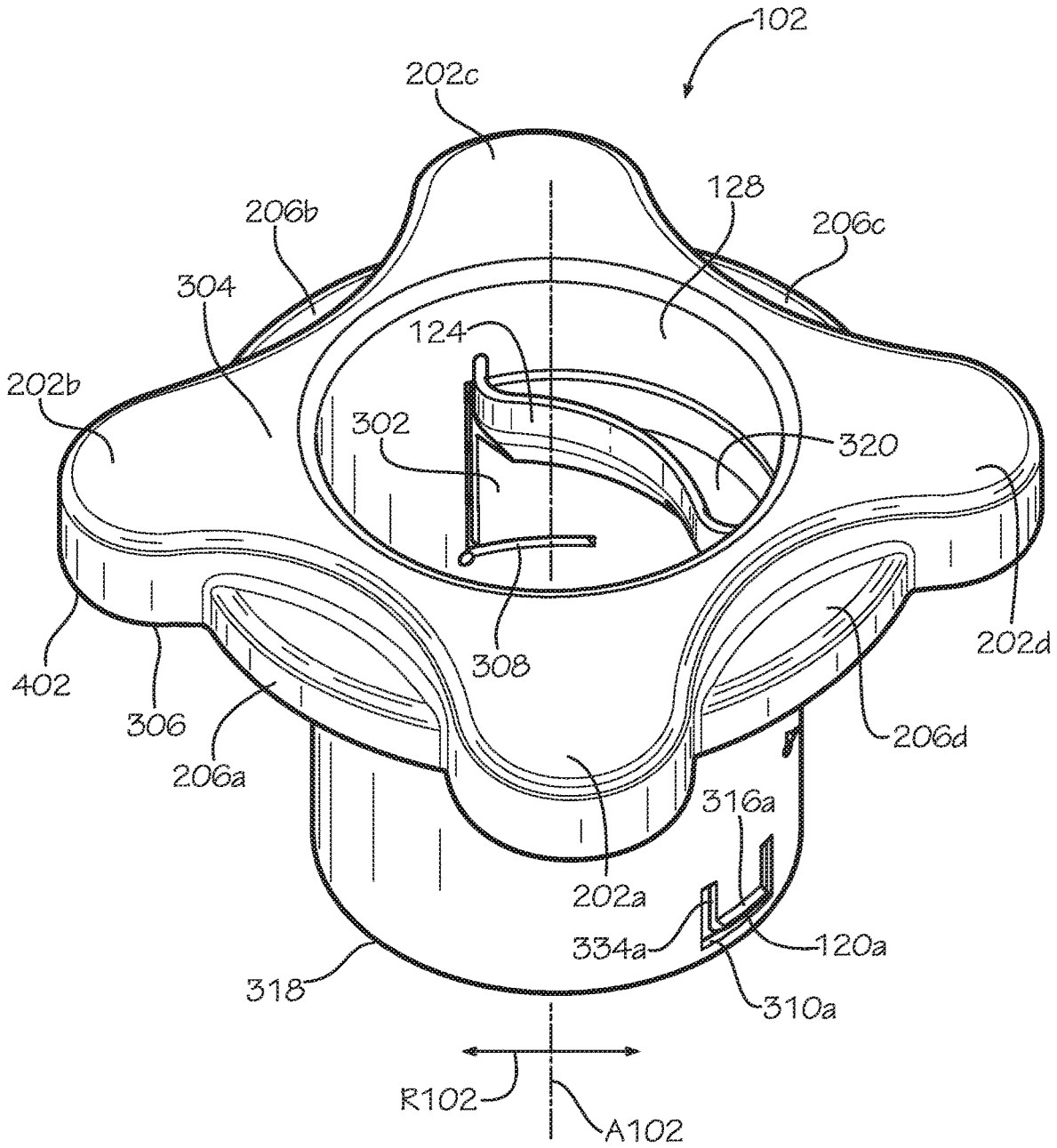
FIG. 2 is a perspective view of the holding member of FIG. 1.
Figure 3:
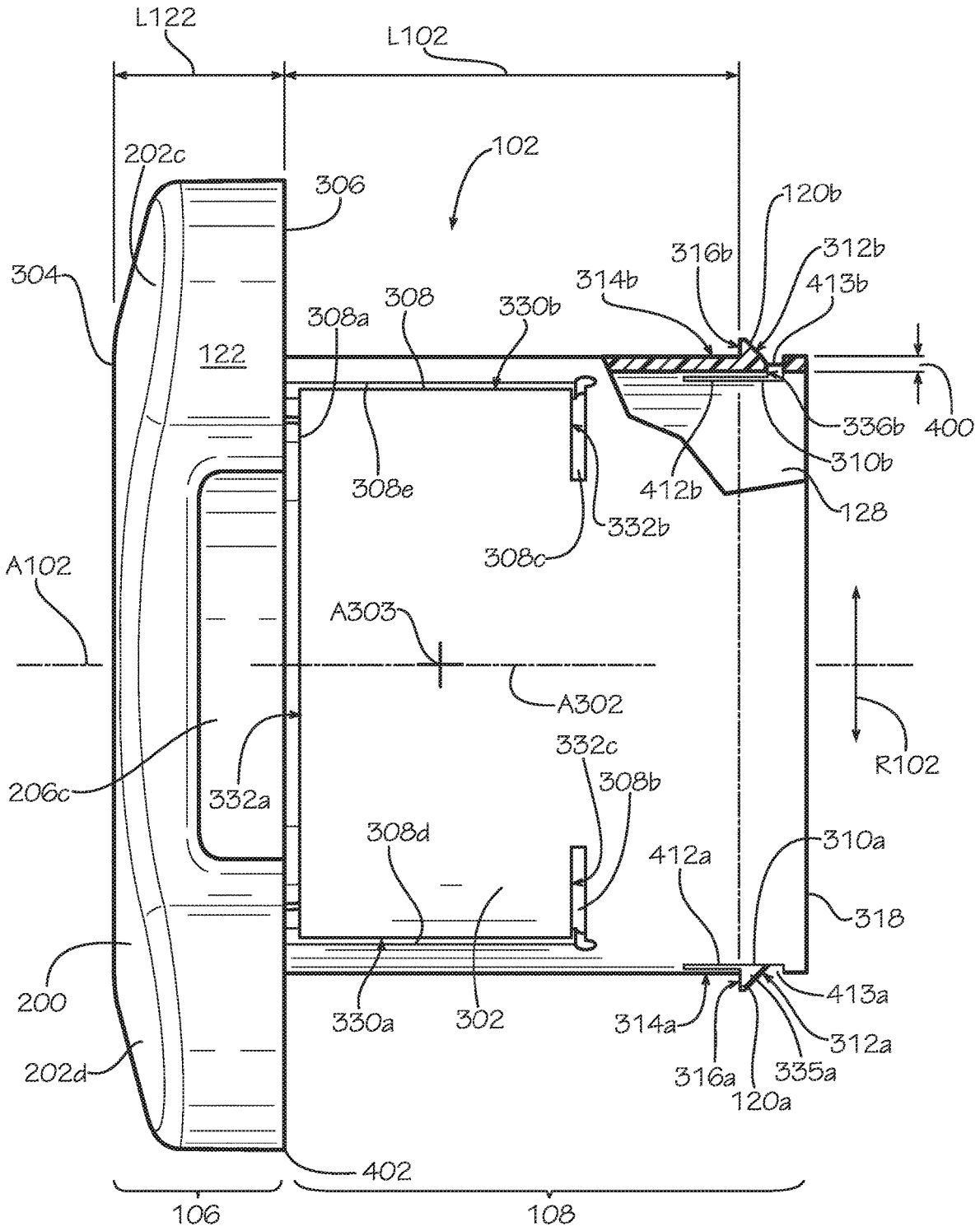
FIG. 3 is a partial cross-sectional rear view of the holding member of FIG. 2 showing a brake portion of the holding member.

FIG. 2 shows the holding member 102 without the rotating member 104 and from a different perspective than shown in FIG. 1. The snap 120*a*, which can be diametrically opposite from the snap 120*b* as shown in FIG. 3, is shown in FIG. 2. Each of the snaps 120*a,b* can be defined by a slot 310*a,b* (310*b* shown in FIG. 3) and can be configured to flex radially inward along the radial direction R102 of the holding member 102 when the second end 108 of the holding member 102 is inserted into the rotating member 104. More specifically, each of the snaps 120*a,b* can define a snap diameter of D120 (shown in FIG. 6), and each of the snaps 120*a,b* can be configured to flex radially inward along the radial direction R102 of the holding member 102 from a diameter value greater than a diameter D108 (shown in FIG. 4) of the second end 108 to a diameter value less than or equal to the diameter D108.

Figure 4:
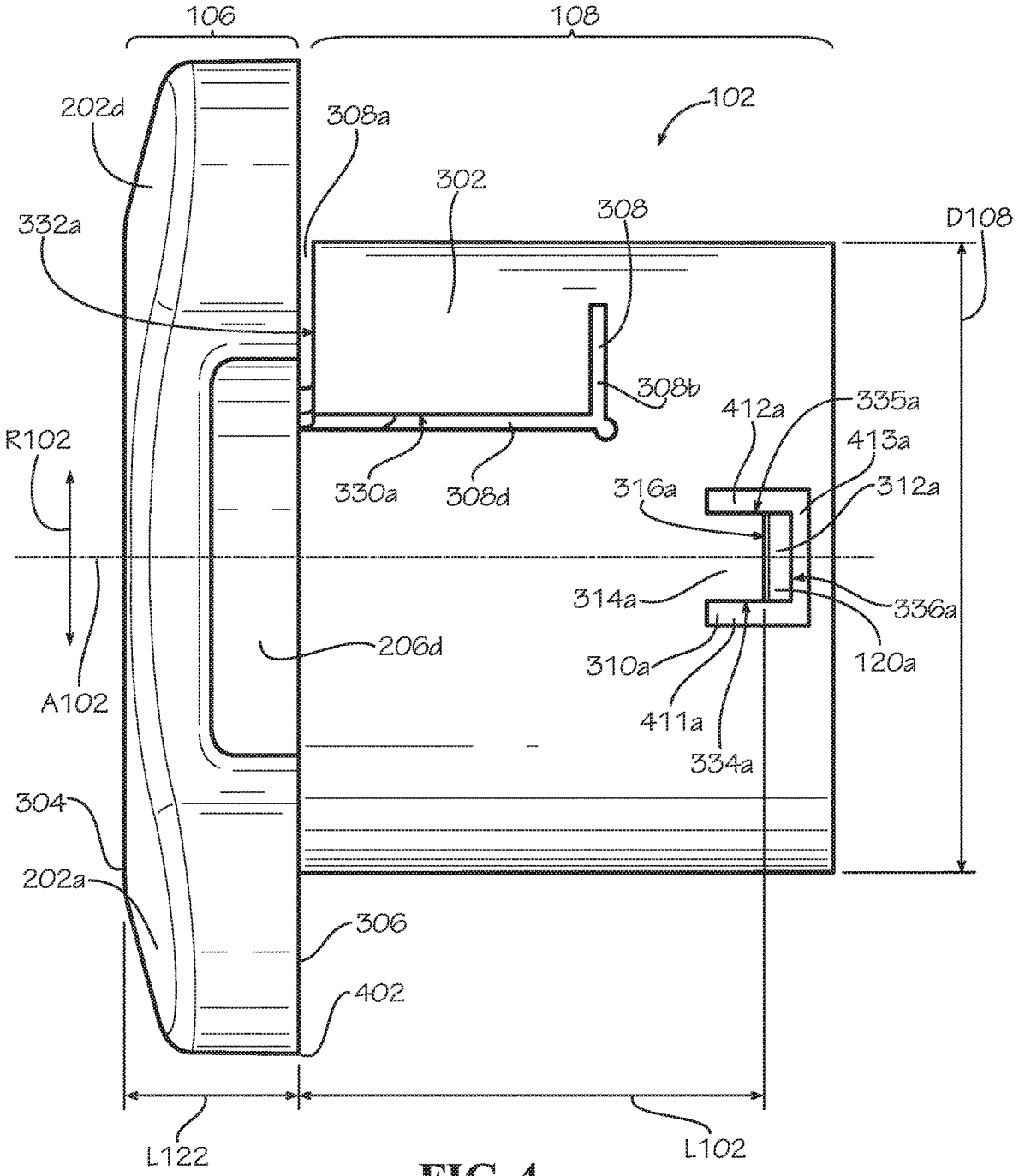
FIG. 4 is a right-side elevation view of the holding member of FIG. 2 showing a snap.
Figure 8:
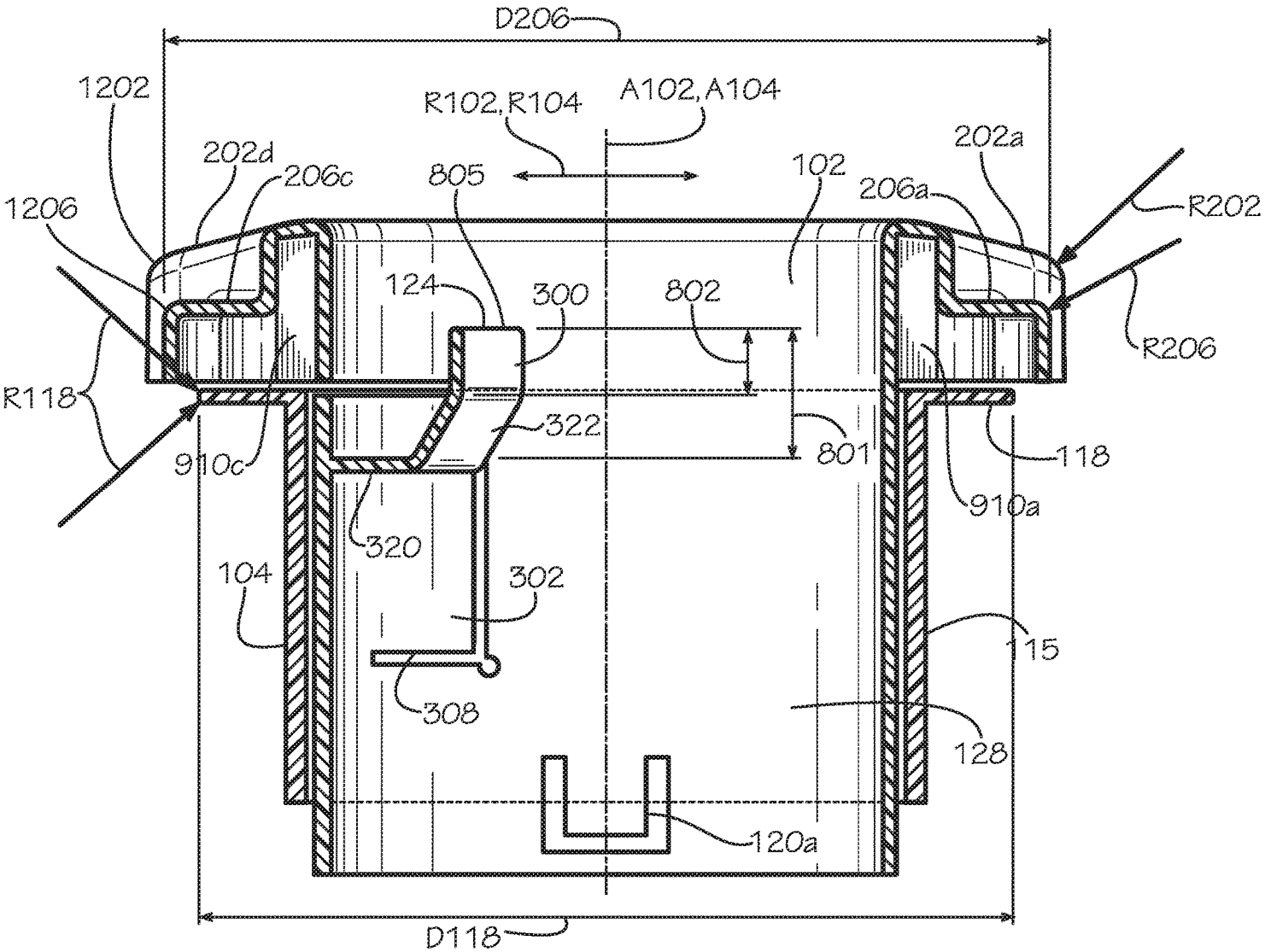
FIG. 8 is a sectional view of the holding member of FIG. 2 taken from line 8-8 of FIG. 5.

Each of the snaps 120*a,b* can comprise a first snap side surface 334*a,b* (334*b* shown in FIG. 12), a second snap side surface 335*a,b* (335*a* shown in FIG. 3, 335*b* shown in FIG. 11), and a snap end surface 336*a,b* (336*a* shown in FIG. 4; 336*b* shown in FIG. 3). Each snap 120*a,b* can comprise a ramp surface 312*a,b* (both shown in FIG. 4), which can be angled with respect to the longitudinal direction A102 to provide a camming motion to the snap 120*a,b* as it is inserted into the rotating member 104 until an outside circumferential surface 314*a,b* (shown in FIG. 3) of each respective snap 120*a,b* faces the inside surface of the rotating member 104 (as shown in FIGS. 7 and 8) and each snap 120*a,b* clears the rotating member 104 and "snaps" back. Each of the snaps 120*a,b* can comprise a catch surface 316*a,b* (316*b* shown in FIG. 3), which can be substantially flat and can face in a direction toward the inside of the holding member 102 along the longitudinal axis A102. Each of the snaps 120*a,b* can be positioned proximate to an outside extremity 318 of the second end 108 of the holding member 102.

As shown in FIG. 3, the holding member 102 can comprise a wall defining a wall thickness 400 that can vary within prescribed ranges. In one aspect, the wall thickness 400 can range from 0.045 to 0.085 inches but more specifically can average about 0.065 inches. In another aspect, the wall thickness 400 can vary outside of this range. In one aspect, each of the holding member 102 and the rotating member 104 can comprise a wall maintaining a consistent wall thickness 400, particularly if each is formed from plastic using an injection molding process. In such a case, it can be advantageous to maintain a consistent wall thickness 400 to avoid potential processing defects such as sink marks or voids. The general design rule is that the variation in the wall thickness of an injection-molded part should be between ±15% to ±25% depending on the shrinkage factor of the material. In another aspect, these components can be made of other suitable materials using other suitable processes, in which case a consistent wall thickness is not necessary.

The outside extremity 304 can be spaced away from the inside extremity 306 or surface, which defines the portion of the first end 106 of the holding member 102 that is nearest the second end 108 of the holding member 102, by a distance L122. In one aspect, the distance L122 can be at least 0.250 inches.

In yet another aspect, the exterior holding surface 122 can be of sufficient length L122 along the longitudinal axis A102 of the holding member 102 that the rotating film roll 902 and the material 910 that is wrapped around the film roll 902 are spaced away from the hand of the user by a desired distance. Increasing this distance can protect the hand from the film roll 902 as the film roll 902 rotates during the film dispensing process. In this aspect, this distance can be as much as 0.75 inches or more, but it is contemplated that the distance could be less, including the aforementioned 0.250 inch for reasons explained later herein. In one aspect, this distance is equal to the length L122 of the exterior holding surface 122, but it is contemplated that the distance could be split into a portion that includes the length L122 of the exterior holding surface 122 and another distance that separates the first end 106 of the holding member 102 from the first end 110 of the rotating member 104 as would be the case if another stop member or flange was added to the holding member 102 and spaced therefrom along the longitudinal axis A102 for contacting the annular flange 118 of the rotating member 104. A gap distance 950 (shown in FIG. 14B) can separate the inside extremity 306 of the holding member 102 from the film roll 902.

A front side of the brake portion 302 of the holding member 102 can be seen in its entirety in FIG. 3. The brake portion 302 can be formed by a cutout in the wall of the second end 108 of the holding member 102 and specifically by the slot 308. The slot 308 can comprise three radial portions 308*a*, 308*b*, 308*c* that can extend in the radial direction R102 of the holding member 102 from an interior surface that defines the hole 128 of the holding member 102 defining an inner diameter D128 (shown in FIG. 5) to the exterior surface 116 defining the outer diameter D108 of the holding member 102. Each of the inner diameter D128 and the outer diameter D108 are measured in a plane that is perpendicular to the longitudinal direction A102 of the holding member 102. The radial portions 308*a,b,c* can also be described as extending in the circumferential direction around the longitudinal axis A102 of the holding member 102. The first radial portion 308*a* of these radial slot portions can define a topmost extent of the brake portion 302 and can be defined in the holding member 102 at or proximate to the intersection of the first and second ends 106,108 of the holding member 102 and can extend completely across and above the brake portion 302. Each of the second radial portion 308*b* and the third radial portion 308*c* can be positioned distal from the first radial portion 308*a* along the longitudinal axis A102. The second radial portion 308*b* and the third radial portion 308*c* can extend partially across the brake portion 302 on either side of the brake portion 302 near or proximate to where the brake portion connects to the wall of the second end 108 of the holding member 102. The slot 308 can also comprise two longitudinal portions 308*d,e* that extend in the longitudinal direction A102 and connect the first radial portion 308*a* with the second radial portion 308*b* and the third radial portion 308*c*, respectively.

As will be described below, the slot 308 can provide the brake portion 302 with enough flexibility so that it can be made to move and contact the rotating member 104 when it is desired to tense the film or other material 910 being unrolled by the film dispenser 100. The brake portion 302 can thus be configured to engage the rotating member 104. In one aspect, a width of the slot 308 can vary from 0.05 to 0.125 inches. In another aspect, widths outside of this range are contemplated. The slot 308 can define two longitudinal extending exterior surfaces 330*a*,330*b* and three radial extending exterior surfaces 332*a,b,c* of the brake portion 302. In one aspect, as shown, a longitudinal center axis A302 and a radial center axis A303 of the brake portion 302 can be positioned halfway circumferentially between the lobe 202*c* and the lobe 202*d* of the handle 200 of the holding member 102. In such an arrangement, the longitudinal center axis A302 and the radial center axis A303 of the brake portion 302 can be positioned halfway circumferentially between any pair of a plurality of radial centerlines 602*a,b,c,d* (shown in FIG. 5). In another aspect, the longitudinal center axis A302 and the radial center axis A303 of the brake portion 302 can be positioned anywhere circumferentially between any pair of adjacent lobes 202*a,b,c,d* relative to the longitudinal axis A102. In another aspect, the longitudinal center axis A302 and the radial center axis A303 of the brake portion 302 can be made to intersect or can be substantially aligned with any of the plurality of the radial centerlines 602*a,b,c,d*.

As shown in FIG. 4, the snap 120*a* can be defined by the slot 310*a*. Each of the snaps 120*a,b* can comprise a first longitudinal portions 411*a*, a second longitudinal portion 412*a*, and a radial or circumferential portion 413*a*. The circumferential portion 413*a* is so named because it extends in a circumferential direction around the longitudinal axis A102 of the holding member 102. A distance L102 can be measured from the inside extremity 306 to the respective catch surfaces 316*a,b* of the snaps 120*a,b*. As mentioned above and will be described in more detail herein, the overall length of the rotating member 104 can be less than the distance from the inside extremity 306 of the first end 106 of the holding member 102 to the catch surface 316 of the snap 120*a,b*, as measured in a direction that is parallel to the longitudinal axis A102 of the holding member 102. It is contemplated that the number, placement, and configuration of the snaps may be altered in various aspects of the present disclosure. For example and without limitation, more than two snaps 120 or only a single snap 120 may be used as well as other variations.

Figure 5:
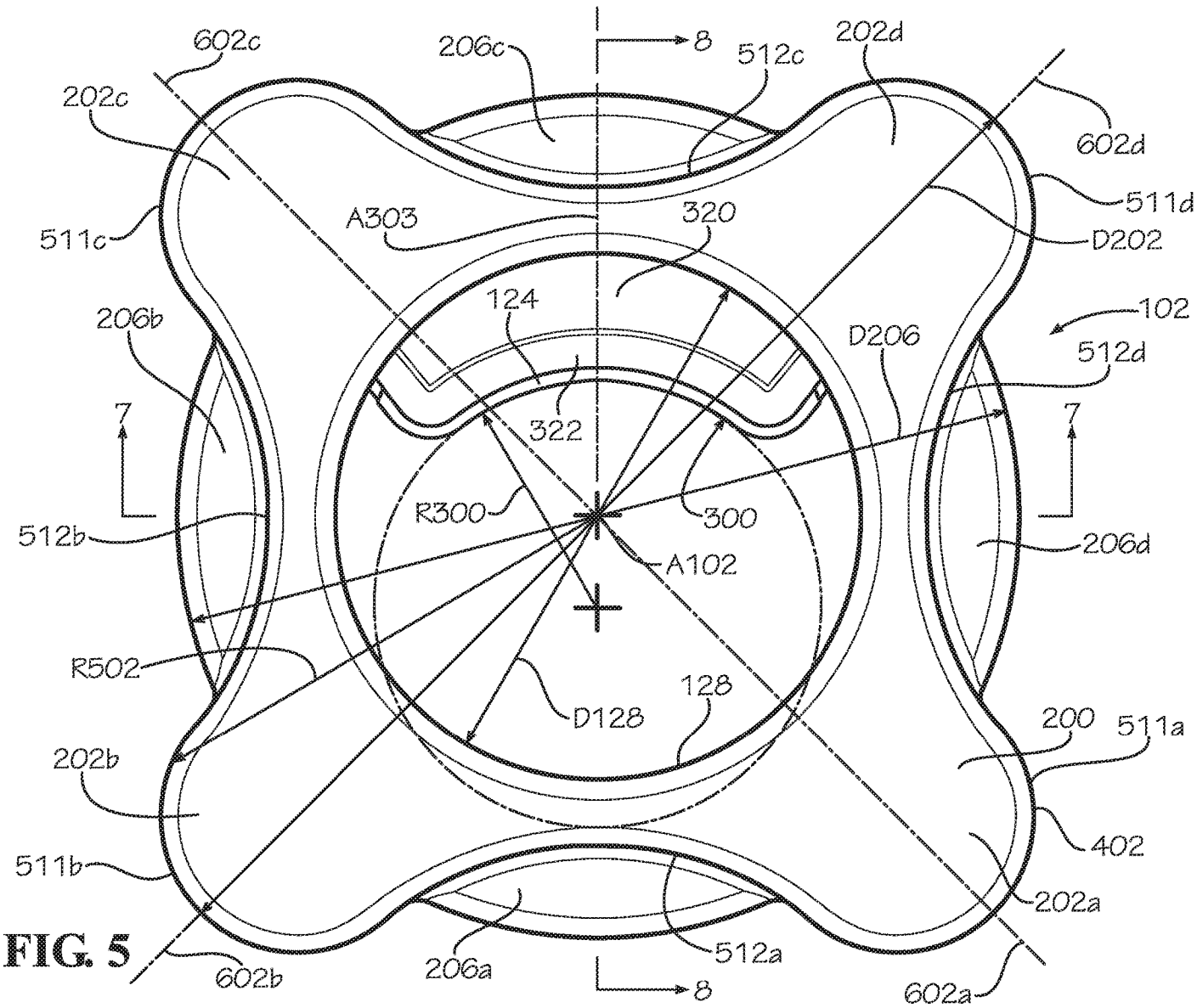
FIG. 5 is a top plan view of the holding member of FIG. 2.
Figure 6:
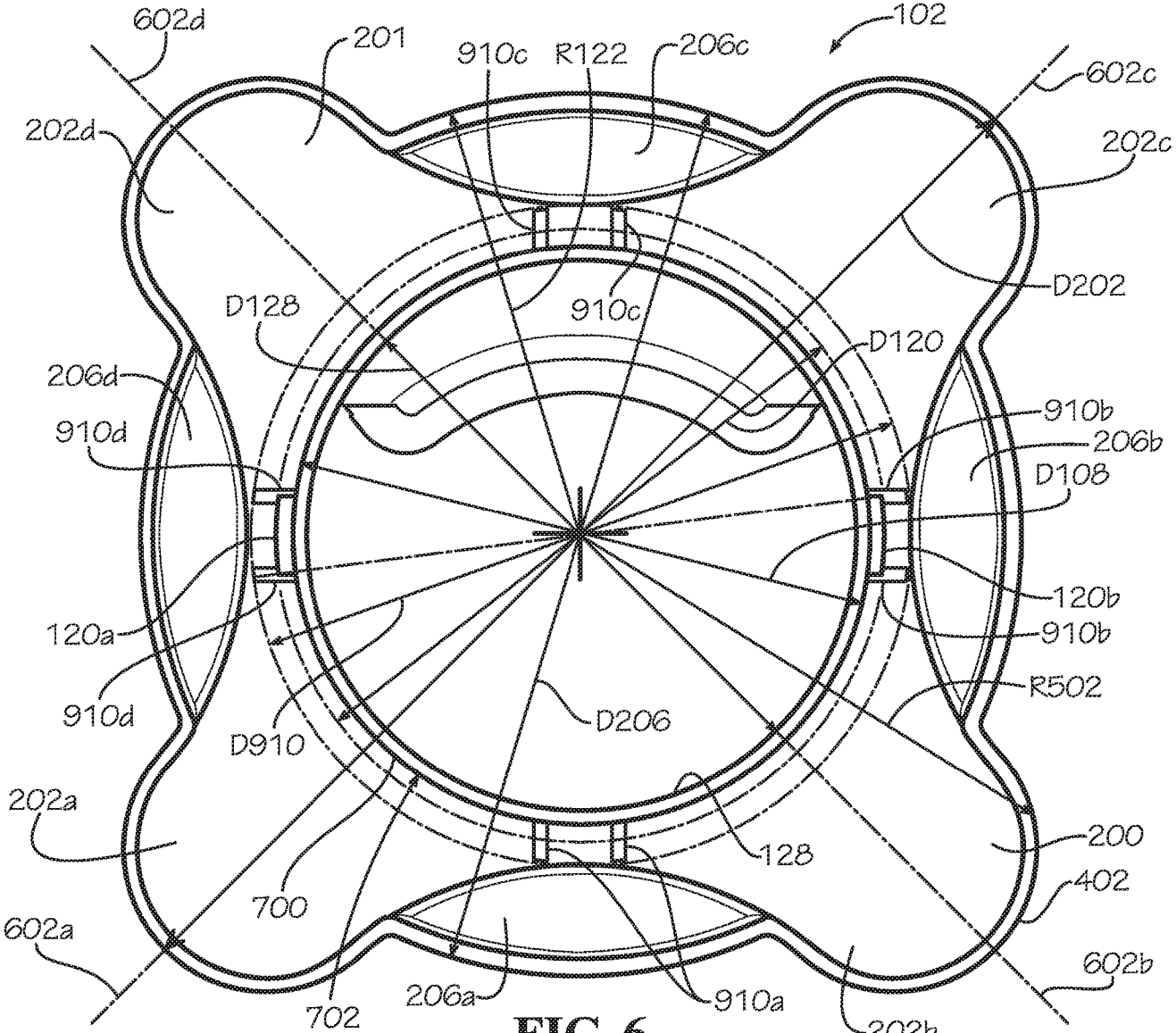
FIG. 6 is a bottom plan view of the holding member of FIG. 2.

As shown in FIGS. 5 and 6, the plurality of lobes 202*a,b,c,d* of the holding member 102 can define an overall lobe diameter D202 and the radial centerlines 602*a,b,c,d*, respectively. Likewise, the plurality of web portions 206*a,b,c,d* of the holding member 102 can define a web portion diameter D206 and a web portion radius R122 (shown in FIG. 6). Also, each of the plurality of lobes 202*a,b,c,d* can define portions that extend radially outward past the plurality of web portions 206,*a,b,c,d* and can define a variable distance R502 measured in a radial direction from the longitudinal axis A102 of the holding member 102 to the handle edge 402. The distance R502 can be greater at the radial centerlines 602*a,b,c,d* than at an angular position that is not aligned with the radial centerlines 602,*a,b,c,d*. Each of the plurality of lobes 202*a,b,c,d* can define a convex or rounded portion 511*a,b,c,d* extending along each respective radial centerline 602*a,b,c,d*, whereas the exterior holding surface 122 can define a concave or recessed portion 512*a,b,c,d* extending between adjacent rounded portions 511*a,b,c,d*. Each of the rounded portions 511*a,b,c,d* and the recessed portions 512*a,b,c,d* can be smoothly shaped, including with a constant radius as desired, to facilitate an ergonomic grip by the user. An intersection between adjoining pairs of each of the rounded portion 511*a,b,c,d* and each of the recessed portion 512*a,b,c,d* can comprise an inflection point or an inflection curve at which point or along which curve a center of a radius of the surface or edge on the handle changes position—for example and without limitation, from a center outside the handle for the recessed portions 512*a,b,c,d* to a center outside the handle for the rounded portions 511*a,b,c,d*, at least as viewed from the perspective of FIGS. 5 and 6. Although any one of a number of different shapes could accomplish this including the shape of the holding member 102 as shown, each lobe 202*a,b,c,d*, and in particular the rounded portions 511*a,b,c,d* and the recessed portions 512*a,b,c,d* can be designed to ergonomically fit the shape of the hand of the user depending on whether the brake portion 302 is positioned between adjacent lobes 202*a,b,c,d* or in another position instead.

As shown, in one aspect, the interior holding surface 300 can comprise a concave surface facing the longitudinal axis A102 of the holding member 102 and defining a radius of curvature R300. In other aspects, the interior holding surface 300 be flat or convex. In one aspect, a center of the radius of curvature R300 can be offset from the longitudinal axis A102 radially outward toward the exterior of the holding member 102 and in such case is not coincident with the longitudinal axis A102 of the holding member 102 or concentric with the central hole 128.

As shown in FIG. 6, the holding member 102 can comprise a plurality of stops 910*a,b,c,d*, each of which can be a rib or a gusset or flange, extending radially outward from an outer surface 702 of a cylindrical portion 700 of the holding member 102 and axially inward from an inner surface 201 of the handle 200. In one aspect, as shown in FIGS. 7 and 8, each of the stops 910*a,b,c,d* can extend in a longitudinal direction from the inner surface 201 of the handle 200 to the inside extremity 306, which as shown can also be where the first end 106 and the second end 108 intersect. In another aspect, each of the stops 910*a,b,c,d* can extend in a longitudinal direction past the inside extremity 306. In one aspect, when the rotating member 104 slides towards the first end of the holding member 102, the stops 910*a,b,c,d* can be configured to contact the rotating member 104 of the film dispenser 100 axially at or outward from the inside extremity 306 relative to the longitudinal axis A102 to prevent the film roll 902 and the rotating member 104 from contacting or sliding underneath the lobes 202*a,b,c,d* and the web portions 206*a,b,c,d* of the first end 106.

Opposing stops of the plurality of stops 910*a,b,c,d* can define a stop diameter D910. By making the stop diameter D910 greater than a diameter D628 (shown in FIG. 9) of a central hole 628 (also shown in FIG. 9) of the rotating member 104, an axial end of each of the stops 910*a,b,c,d* can be made to contact the annular flange 118 of the rotating member 104. By contacting the annular flange 118 of the rotating member 104, the holding member 102 can be held at a desired distance relative to the rotating member 104. At each position of the stops 910*a,b,c,d*, the holding member 102 can comprise a pair of stops 910*a,b,c,d*. By increasing the number of stops 910*a,b,c,d*, an axial load each stop 910*a,b,c,d* and the stresses (including mechanical stress and heat) experienced inside each stop 910*a,b,c,d* can be kept at a minimum. In one aspect, each of the stops 910*a,b,c,d* can be centered between adjacent radial centerlines 602*a,b,c,d*. In another aspect, the stops 910*a,b,c,d* can be positioned in a different circumferential position. In yet another aspect, additional stops or fewer stops can be used.

As shown in FIG. 7, the rotating member 104 can define an overall length L104.

As shown in FIG. 8, each of the lobes 202*a,b,c,d* can comprise a blend 1202, which can define a blend radius R1202, and each of the web portions 206*a,b,c,d* can comprise a blend 1206, which can define a blend radius R1206. Either of the blend radius R1202 or the blend radius R1206 can be decreased or increased from that shown. In one aspect, as shown, the blend 1202 and the blend 1206 can define less than a full radius (i.e., the blend 1202 and the blend 1206 can be sized to not fill or cover the entire outside edge of the handle 200 between the outside extremity 304 and the inside extremity 306). In another aspect, the blend 1202 and the blend 1206 can define a full radius along at least a portion of the handle 200 for a different look and/or feel. Also as shown, an edge—or a plurality of edges—of the annular flange 118 of the rotating member 104 can comprise a blend defining a blend radius R118. In yet another aspect, either the blend 1202 or the blend 1206 can vary around the perimeter of the handle 200 or can otherwise have a more complex shape that is not necessarily constant in radius or even curved.

In one aspect, as shown, a diameter D118 of the annular flange 118 can be less than the diameter D206 defined by the web portions 206*a,b,c,d*. This construction can help keep the rotating annular flange 118 away from the user's hand during use of the film dispenser 100.

Also as shown in FIG. 8, portions of the rail 124 and interior holding surface 300 can be considered to be part of the first end 106 of the holding member 102, even though portions of each directly extend from the second end 108 and are otherwise not connected directly to other portions of the first end 106 of the holding member 102. In one aspect, because the rail 124 and its interior holding surface 300 can be connected to the brake portion 302 by the transition portion 322 and the connecting portion 320 of the second end 108 of the holding member 102, the rail 124 and its interior holding surface 300 can thereby be operatively associated with the brake portion 302, as any force directed in an outward direction along the radius R102 of the holding member 102 against the rail 124 moves the brake portion 302. In another aspect, this operative association can be achieved in other ways such as, for example and without limitation, by having the rail 124 connected directly to the brake portion 302. Also, the rail 124 and the interior holding surface 300 can both be incorporated into the second end 108 of the holding member 102 by positioning both below the intersection of the first end 106 and the second end 108 of the holding member 102, which coincides with an edge of the slot 308*a* defining in part the brake portion 302.

Figure 9:
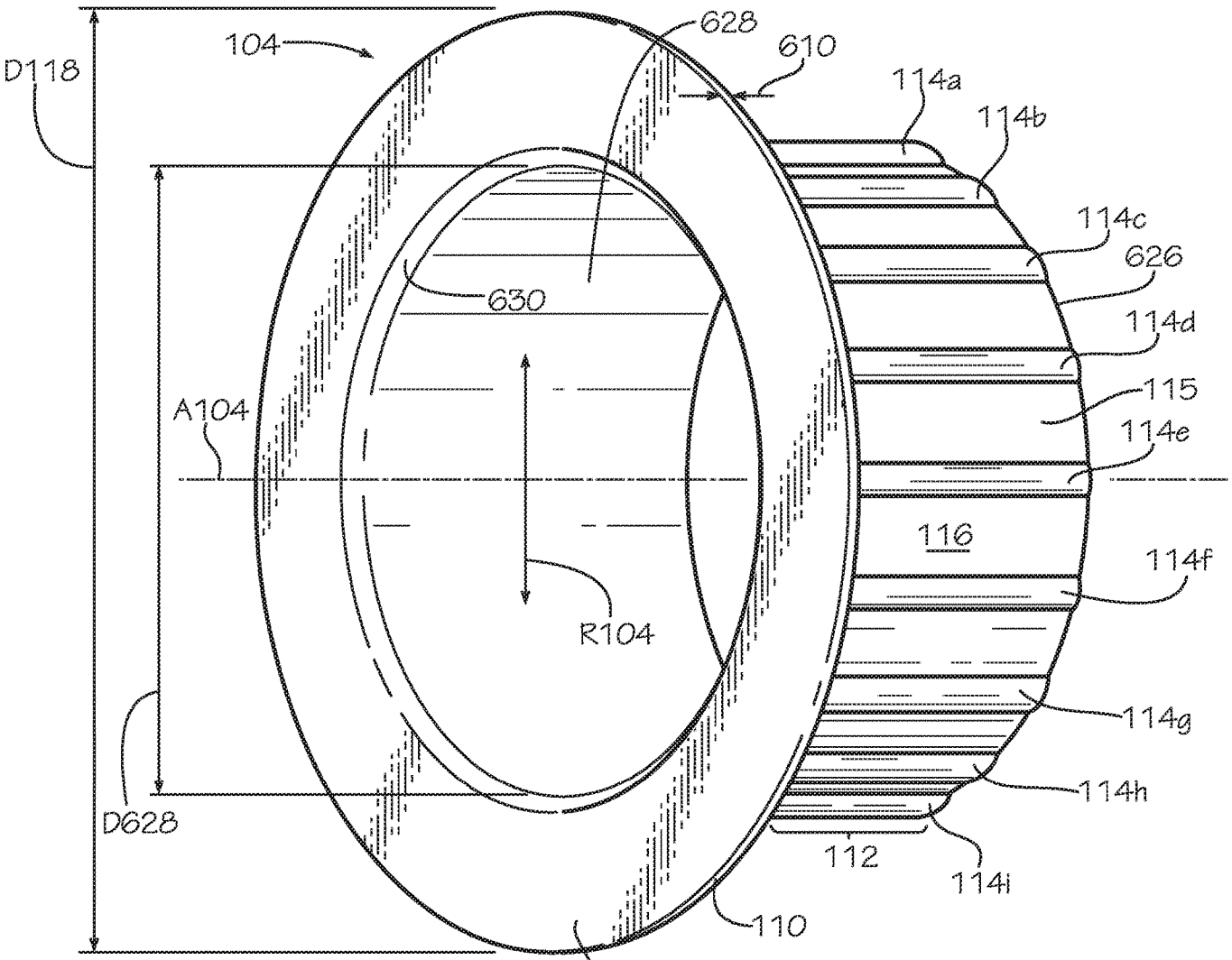
FIG. 9 is a perspective view of the rotating member of the film dispenser of FIG. 1.
Figure 10:
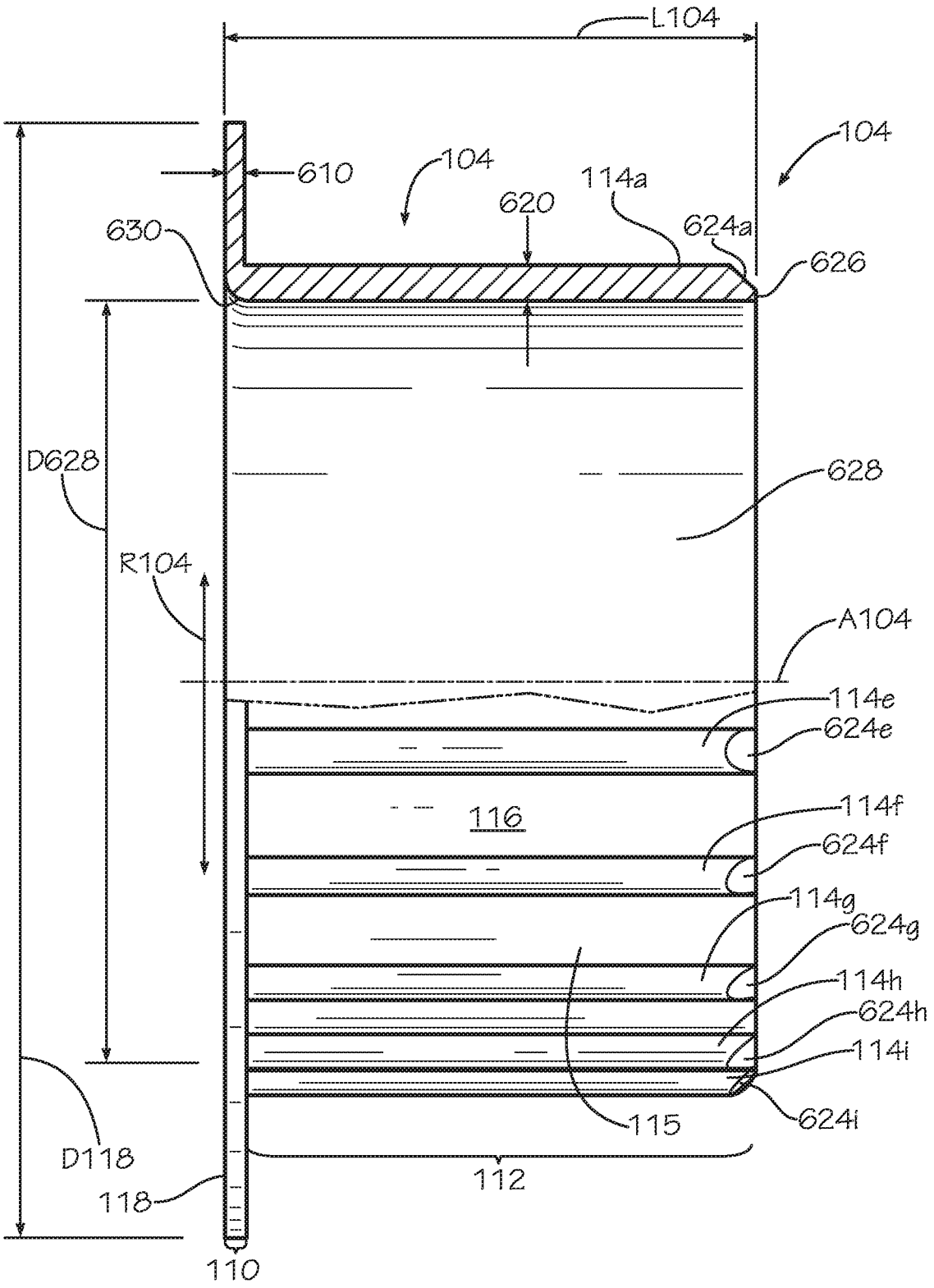
FIG. 10 is a partial cross-sectional side view of the rotating member of FIG. 6.

FIGS. 9 and 10 show the detailed structure of the rotating member 104, which as noted above can define a substantially annular or tubular shape and can comprise the features noted. The first end 110 can comprise an abutment portion in the form of the annular flange 118. The annular flange 118 can define a wall thickness 610 measured in the direction of the axis of rotation A104 and a wall thickness 620 (shown in FIG. 10) measured along the radial direction R104 of the rotating member 104. The second end 108 can comprise a tube or sleeve portion such as the sleeve 115, which can comprise the cylindrical exterior surface 116 with the ribs 114. The ribs can be configured to engage the inside of the film roll 902 in a frictionally desirable manner, helping to keep the film roll 902 from falling off the film dispenser 100. The cross section of one of the ribs 114 can comprise a semi-circular shape. For example and without limitation, each of the ribs can define an outside radius of 0.156 inches when looking at a cross-section taken along the radial direction R104 of the rotating member 104. In one aspect, ends 624*a-j* (shown in FIG. 12) of the ribs 114 adjacent to an outside extremity 626 of the second end 112 of the rotating member 104 can be angled at 45 degrees from the axis of rotation A104, providing a lead-in for inserting the rotating member 104 into the film roll 902. In another aspect, the ends 624*a-j* of the ribs 114 adjacent to an outside extremity 626 of the second end 112 of the rotating member 104 can be angled at more than 45 degrees or less than 45 degrees from the axis of rotation A104. Either of the wall thicknesses 610,620 of the rotating member 104 can vary from 0.045 to 0.085 inches and can average 0.65 inches. Again, the rotating member 104 can measure the overall length L104.

The central hole 628 of the rotating member 104 can define a diameter D628 and can be sized to receive the second end 108 of the holding member 102. Specifically, the diameter D628 of the central hole 628 can be made slightly greater than the outside diameter D108 (shown in FIG. 4) of the second end 108 of the holding member 102. A blend 630 can be defined at the entry of the central hole 628 proximate to the first end 110 of the rotating member 104 to provide a lead-in for inserting the holding member 102 into the rotating member 104. The outer diameter D118 of the annular flange 118 can be substantially the same as the outer diameter D206 of the first end 106 of the holding member 102. It is contemplated that the dimensions associated with various features of the rotating member 104 can be changed to adapt to a smaller or larger film roll 902 and a smaller or larger holding member 102.

Figure 11:
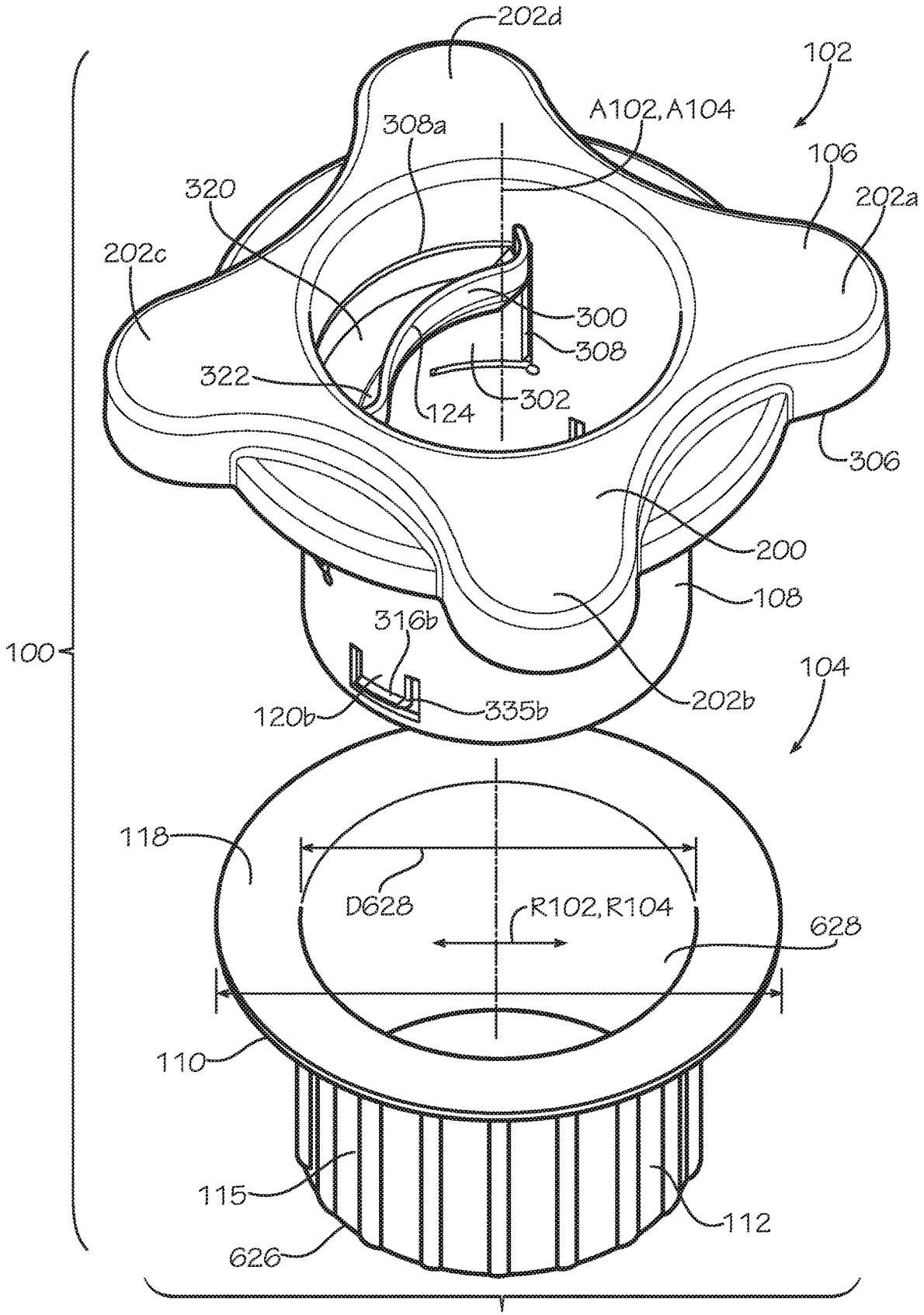
FIG. 11 is a top perspective exploded assembly view of the film dispenser of FIG. 1 showing how the holding member and rotating member can be assembled.
Figure 12:
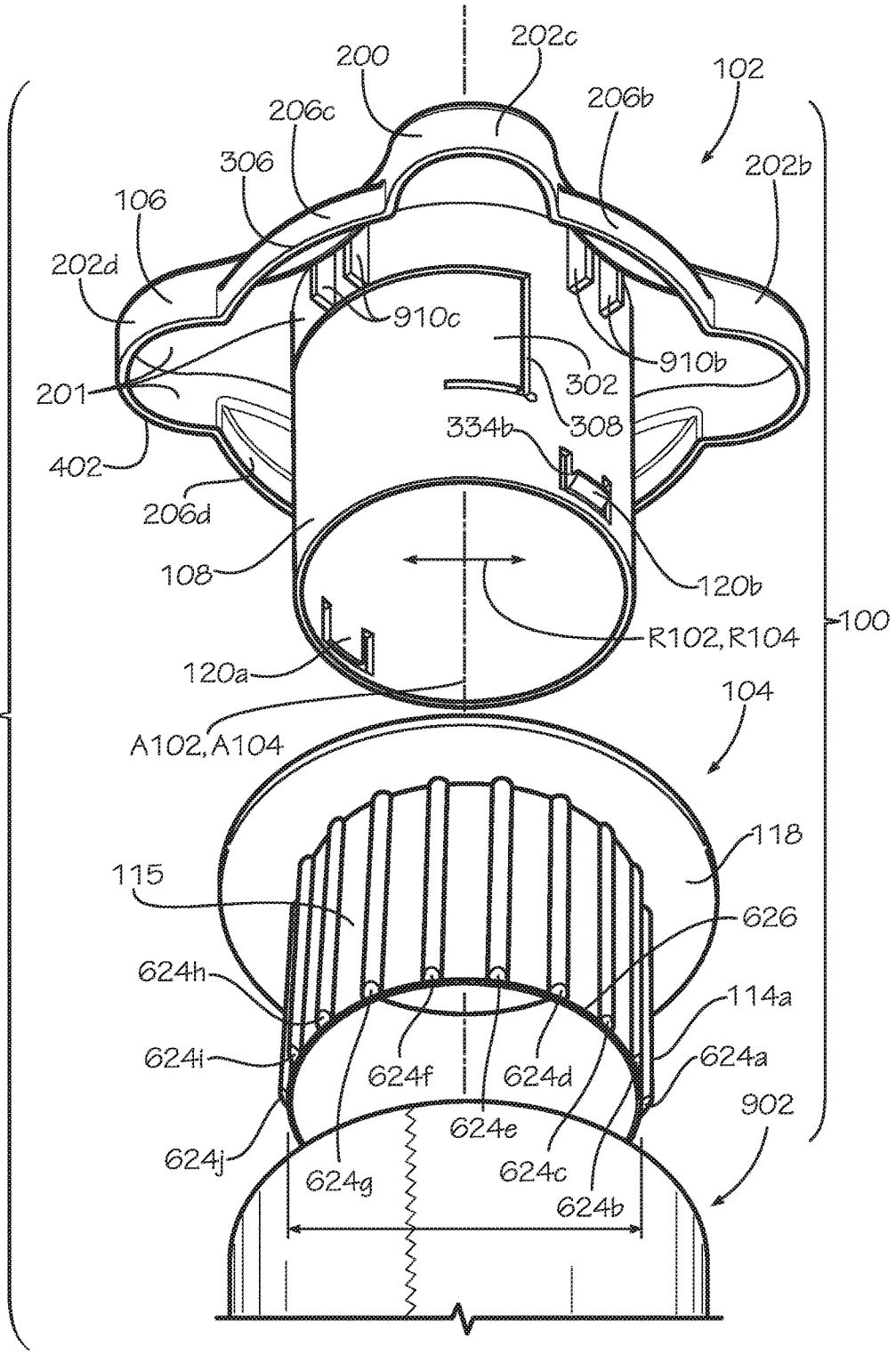
FIG. 12 is a bottom perspective exploded assembly view of the film dispenser of FIG. 1 being assembled together with a film roll.
Figure 13:
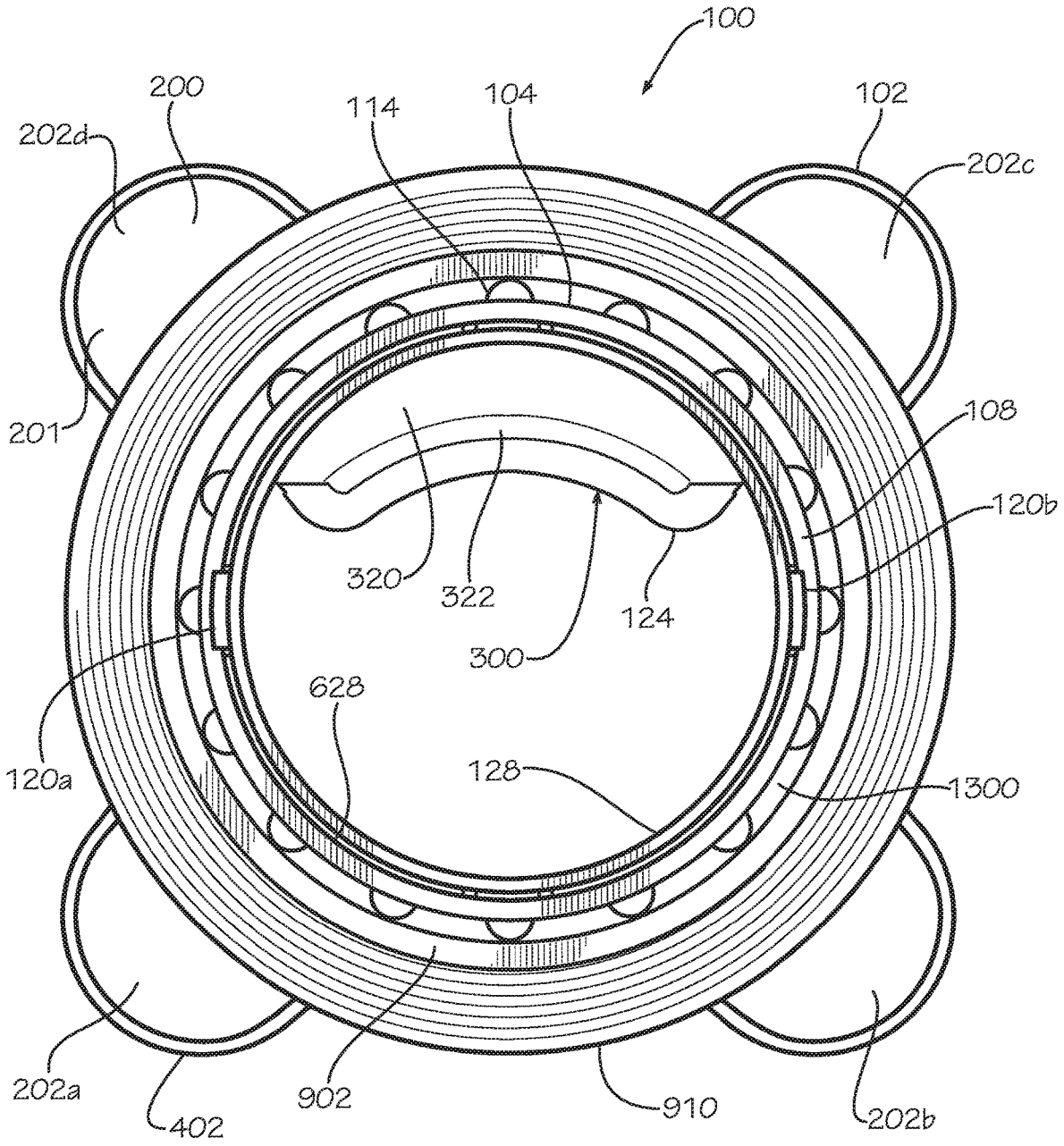
FIG. 13 is a bottom plan view of the film dispenser and the film roll of FIG. 12 after all three components (the film dispenser holding member, the film dispenser rotating member, and the film roll) have been assembled.

FIGS. 11, 12, and 13 show further how the holding member 102 and the rotating member 104 can be assembled and how the film dispenser 100 can be coupled to the film roll 902. First, the rotating member 104 can be inserted into an opening defined in an end of the film roll 902 until its abutment portion or the annular flange 118 of the first end 110 contacts the end of the film roll 902. At this point, the ridges or ribs 114 can be completely enveloped in or received within the film roll 902 and can be configured to frictionally hold the rotating member 104 inside the film roll 902 (as shown in FIG. 13). Next, the second end 108 of the holding member 102 can be inserted into the central hole 628 of the rotating member 104. As the holding member 102 is inserted into the rotating member 104, the snaps 120*a,b* can be pushed radially inward by the sleeve 115 of the rotating member 104 until the second end 108 of the holding member 102 extends past the second end 112 of the rotating member 104, at which time the snaps 120*a,b* can be configured to "snap" back and return to their original position and the catch surfaces 316*a,b* of the snaps 120*a,b* can capture the outside extremity 626 of the second end 112 of the rotating member 104. At about the same time, in one aspect, the annular flange 118 can contact or nearly contact the inside extremity 306 of the first end 106 of the holding member 102. In other aspects, the annular flange 118 can contact the stops 901*a,b,c,d* of the holding member 102 with the inside extremity 306 or before the annular flange 118 contacts the inside extremity 306. In either aspect, the first end 106 of the holding member 102 can be spaced away or offset from an edge of the material 910 that is dispensed from the film roll 902 during dispensing. Because the overall length L104 of the rotating member 104 can be less than the distance L102 from the inside extremity 306 to the catch surfaces 316*a,b* of the snaps 120*a,b* (as shown in FIG. 7), the rotating member 104 can fit between the snaps 102*a,b* and the inside extremity 306 of the first end 106 of the holding member 102.

As shown in FIG. 12, the stops 910*a,b,c,d* (910*a* and 910*b* shown in FIG. 6) can prevent the rotating member 104, and the annular flange 118 in particular, from riding up inside the handle 200 or inside the first end 106 of the holding member 102.

FIG. 13 shows the film roll 902, rotating member 104, and holding member 102 in a completely assembled state. In one aspect, the rotating member 104 can be held in place relative to the film roll 902 by friction alone. The rotating member 104 can be held inside the film roll 902 be an interference fit between the rotating member 104—and specifically the ribs 114 (shown in FIG. 1)—that can cause the ribs 114 to dig into and bear against the walls of the core of the film roll 902.

In another aspect, the rotating member 104 is held in place with an adhesive placed in a radial gap 1300 defined between the rotating member 104 and the film roll 902. In various aspects, the film dispenser 100 can be removable from the film roll 902, though in other aspects the film dispenser 100 may not be removable from the film roll 902.

Figure 14A:
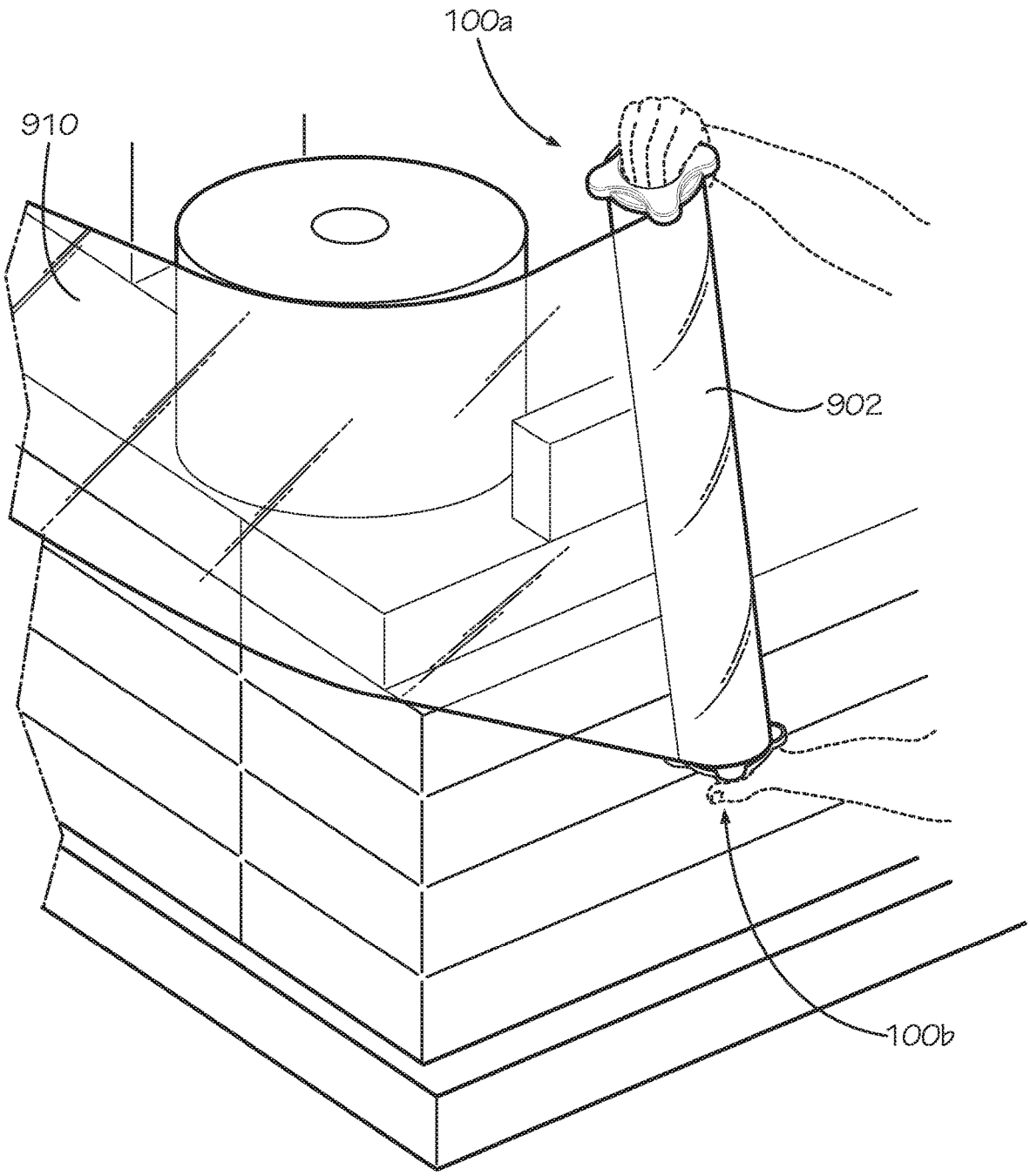
FIG. 14A is a perspective view of the film roll in use, with each of two film dispensers attached to the film roll at either end.
Figure 14B:
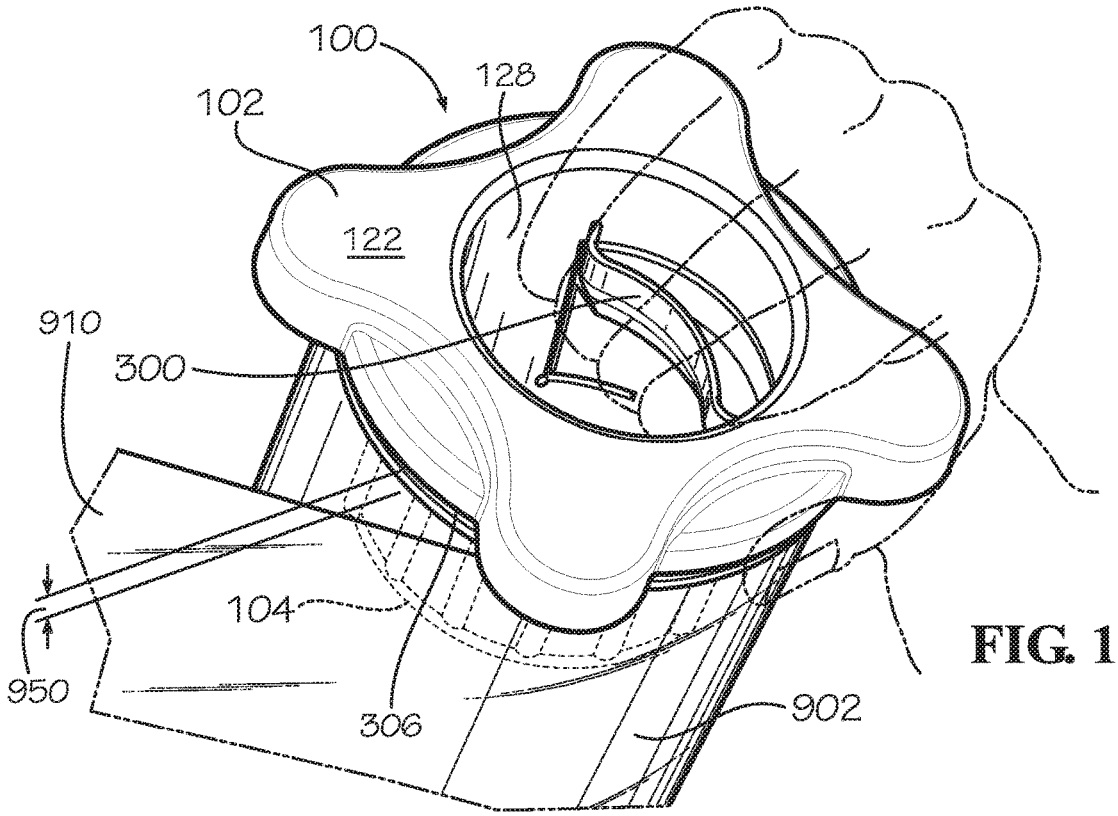
FIG. 14B is an enlarged view of a film dispenser and the film roll of FIG. 14A depicting how the film dispenser can be held in the hand of a user.
Figure 14C:
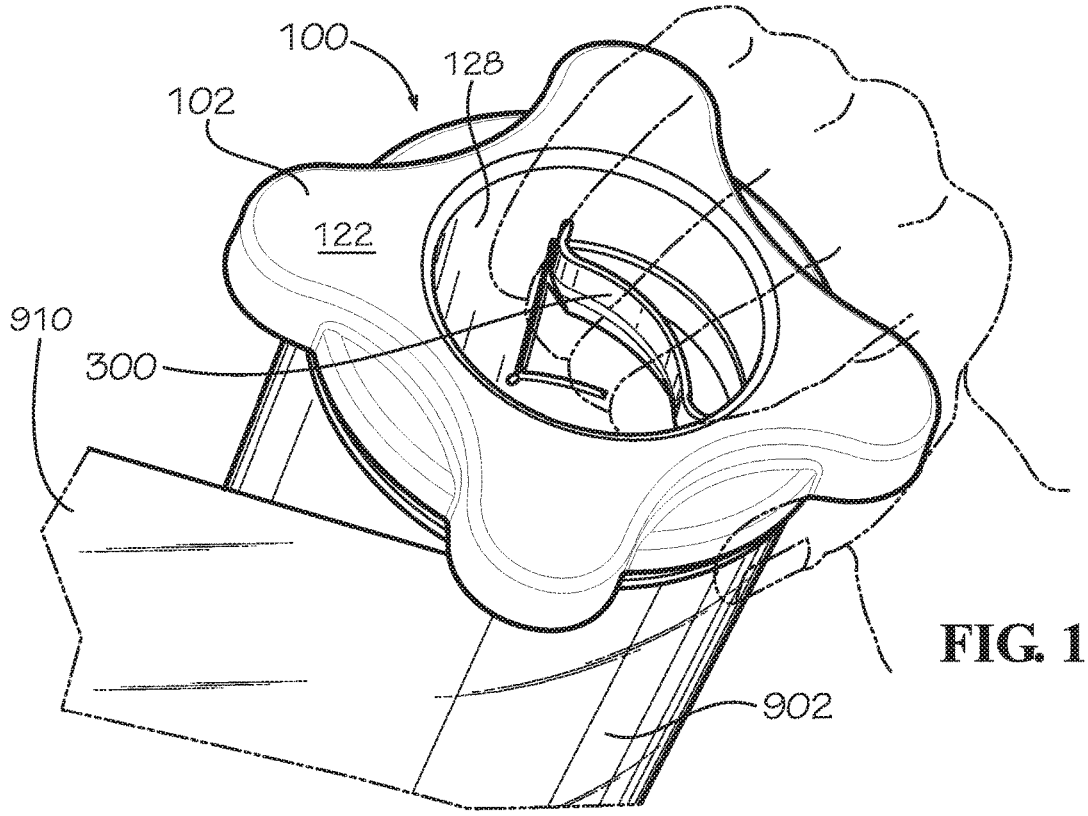
FIG. 14C is an enlarged view of a film dispenser and the film roll of FIG. 14A depicting how the film dispenser can be held in the hand of the user in accordance with another aspect of the current disclosure.

As shown in FIG. 14A, the aforementioned process of assembling the film dispenser 100 can be repeated at the other end of the film roll 902 so that two film dispensers 100*a,b* (shown in FIG. 14A) are positioned at opposite ends of the film roll 902. The user can then use the film dispensers 100*a,b* to unroll the material 910 from the film roll 902. FIGS. 14A through 14C show how the film dispenser 100 can be used to dispense the material 910 and how a film dispenser 100 can be held in the hand of the user.

FIG. 14B in particular show how, for example and without limitation, a film dispenser 100 can fit into the hand of the user, allowing the fingers to fit within the central hole 128 of the holding member 102 and the thumb and a portion of the palm to be placed on the exterior holding surface 122 of the holding member 102. As the material 910 is being dispensed, a clenching of the hand will cause the brake portion 302 of the holding member 102 to move radially outward and impinge on the rotating member 104, causing the rotating member 104 to slow down or stop rotating altogether, causing tensioning or even stretching of the film as the user continues to move the film roll 902 about the item to be wrapped or covered, all as has been previously described.

As shown in FIG. 14C, a holding member 102 can be installed in the film roll 902 without a rotating member 104. In order to fit and function properly, the diameter D108 of the holding member 102 can be increased so that clenching of the hand about the holding member 102 to engage the brake portion 302 causes the brake portion 302 to move radially outward and impinge on an inner bore of the film roll 902, causing the film roll 902 to slow down or stop rotating altogether, causing tensioning or even stretching of the material 910 as the user continues to move the film roll 902 about the item to be wrapped or covered. With or without use of the rotating member 104, any surface of the holding member, the rotating member 104, or the inner bore of the film roll 902 can be roughened or textured or supplemented with an additional polymeric or other material (held in place, for example and without limitation, by adhesive or by an overmolding process) to increase the friction between adjacent components and in particular, for example and without limitation, increase the grip of the brake portion 302 against the surface it is configured to slow down or stop.

The slots 308 that can define the brake portion 302 and the slots 310 that can define the snaps 120*a,b* can result in "undercuts" on the part to be considered when a molding or casting process is used to make the holding member 102. As a result of these undercuts, a "side action" or multiple side actions can be used to form these structures as the holding member 102 is being molded. These side actions can then retracted, allowing the ejection of the holding member 102 from the mold. For example and without limitation, each of two side actions can be used to make one snap 120 and half of the slots 308 that define the brake portion 302. With such a design, the side actions would move in a direction that is perpendicular to the longitudinal axis A102 and parallel to the radial direction R102.

The brake portion 302 can be operatively associated with the rail 124 and the interior holding surface 300. Movement of the brake portion 302 relative to the other portions of the holding member 102 can be made possible by the slot 308 defined in the holding member 102, which can be defined in the second end 108. More specifically, if sufficient force is exerted by the fingers of a user, the brake portion 302 can be deflected outwardly along the radial direction R102 of the holding member 102 until the brake portion 302 contacts the rotating member 104, creating enough friction to stop or at least retard the rotation of the rotating member 104. Because the rotating member 104 is held tight inside an inner bore of the film roll 902 by, for example and without limitation, friction or an adhesive material between the rotating member 104 and the film roll 902, stopping or retarding the motion of the rotating member 104 can stop or retard the motion of the film roll 902. This, in turn, can cause any stretch wrap or film being dispensed to be tensed and, to the degree desired, stretched a certain amount. When these effects are no longer desired, the user simply releases the brake portion 302 by removing enough force from the interior holding surface 300 of the rail 124 so that the brake portion 302 springs back inwardly along the radial direction R102 of the holding member 102 and no longer contacts the rotating member 104. Although the operative association between the rotating member 104 and the brake portion 302 may be direct, such as when the brake portion 302 is able to engage the rotating member 104 directly or contact it directly, the operative association may also be indirect as may be the case when other components are found between the brake portion 302 and the rotating member 104.

As desired, the length of the rail 124 in the direction of the longitudinal axis A102 including a lever distance 801 (shown in FIG. 8) measured from an axial end 805 (shown in FIG. 8) of the rail 124 to where the connecting portion 320 intersects with the brake portion 302 or a lever distance 802 (also shown in FIG. 8) measured to the point where the brake portion 302 contacts the rotating member 104 or the inside bore of the film roll 902 can be adjusted to increase or decrease the amount of leverage created by the hand of the user or to adjust the ergonomic feel of the holding member 102 in the hand of the user. For example and without limitation, increasing a distance from where the hand contacts the rail to where the connecting portion 320 intersects with the brake portion 302 or where the brake portion 302 contacts the rotating member 104 or the inside bore of the film roll 902 can reduce the amount of force required to engage the brake portion 302 and thereby slow the rotating member 104 and/or the film roll 902.

As mentioned above with respect to FIG. 1, the first end 106 of the holding member 102 can comprise the blend 126 for guiding the insertion of a hand into the central hole 128 of the holding member 102. Once a hand is positioned inside the holding member 102, it can press onto the interior holding surface 300 found on the rail 124 that is operatively associated with the brake portion 302 of the holding member 102. An example of how this operative association can be created will now be explained with reference to FIGS. 2 and 11. As already stated, the top radial portion of the slot 308*a* that defines the brake portion 302 can be positioned at the division of the holding member 102 into its first and second ends 106, 108 (see FIG. 4). Therefore, any structure found above this top longitudinal portion of the slot 308*a* can be considered part of the first end 106 of the holding member 102. As already explained, the connecting portion 320 can be located toward the interior of the holding member 102 along the longitudinal axis A102 and away from the outside extremity 304 of the first end 106 of the holding member 102, the connecting portion 320 extending in a plane that is perpendicular to the longitudinal axis A102 of the holding member 102. Also, the connecting portion 320 or member can be located below the top radial portion of the slot 308*a* and can extends in an inner radial direction R102 toward the rail 124, which can extend above the top radial portion of the slot 308*a*. The transition portion 322 can connect or attach the connecting portion 320 to the rail 124 and its associated interior holding surface 300 and can be angled with respect to the longitudinal direction A102 and with respect to the connecting portion 320 as shown in FIG. 8. The connecting portion 320 can be located toward an interior of the holding member 102 along the longitudinal axis A102 and away from an outside extremity 304 of the first end 106 of the holding member 102. The connecting portion 320 can extend radially inward from any portion of the brake portion 302 and can extend in a plane that is angled with respect to the longitudinal axis A102 of the holding member 102.

A method of dispensing the material 910 from the film roll 902 using the film dispenser 100 can comprise holding onto the interior holding surface 300 and the exterior holding surface 122 of a holding member 102 of the film dispenser 100 with one hand such that a portion of the hand is positioned between a pair of the adjacent lobes 202*a,b,c,d* of the plurality of lobes 202*a,b,c,d* of the holding member 102, the holding member 102 comprising the first end 106 comprising the interior holding surface 300 and the plurality of lobes 202*a,b,c,d* defining the exterior holding surface 122; and the second end 108 comprising a brake portion 302; wherein the second end 108 of the holding member 102 is inserted into an opening defined in the first end of the film roll 902; dispensing the material 910 by rotating the film roll 902 relative to the holding member 102; and pressing onto the brake portion 302 to increase the tension in the material 910 being dispensed. The method of pressing onto the brake portion 302 can comprise contacting a rotating member 104 of the film dispenser 100 with the brake portion 302 to create friction between the brake portion 302 and the rotating member 104 of the film dispenser 100. The method can further comprise preventing movement of a one of the film roll 902 and a rotating member 104 of the film dispenser 100 past an intersection of the first end 106 and the second end 108 of the holding member 102.

It should be noted that any of the steps of any of the methods described herein may be performed in any order or could be performed in sub-steps that are done in any order or that are separated in time from each other by other steps or sub-steps. Similarly, the steps of inserting the holding member 102 into the rotating member 104 and inserting the rotating member 104 into the film roll 902 can be done in any order as both effectuate the same end result, that is to say, the film dispenser 100 is operatively engaged with the film roll 902. The same principle can be applied to any step of any method disclosed herein. Additional steps may also be added. For example and without limitation, the holding member 102 can be assembled to the rotating member 104 before both are inserted into the film roll 902.

The assembly configurations described herein represent some of many possible assembly configurations. One skilled in the art will understand obvious variations of this assembly configuration are included within this disclosure, including variations of steps, combinations of steps, and dissections of steps, among others. Where materials are chosen for the elements of this assembly—particularly, rubber, metal, and plastic—similar material choices may also be used and would be obvious to one in the art. The rotating member 104 and/or the holding member 102 may be made of cast iron, steel, aluminum, titanium, copper, brass, various plastics, polymers, resins, or any material. In one aspect, the rotating member 104 and/or the holding member 102 can be made of a material of sufficient strength to withstand the loads placed on them when the material 910 or other materials from the film roll 902 and yet be resilient enough to allow snapping of the holding member 102 and the rotating member 104 together as well as movement of the brake portion 302. In another aspect, the brake portion 302 and/or the snaps 120*a,b* can be formed separately from and assembled to the holding member 102. It is contemplated that many of the features that have been described herein as being part of either the holding member 102 or the rotating member 104 could be switched to the other of the holding member 102 or the rotating member 104 including the snaps 120*a,b* and that features found completely in one member could be split in some cases between the two members. Furthermore, the configuration of either member need not be annular but could be otherwise depending on the application. Finally, additional members may be added to the film dispenser 100 and various components may be split into other components. For example, an elastomeric component may be applied to the handle portion of the holding member 102 or the surface texture of the holding member 102 otherwise configured to aid in grip and ergonomics. In such a case, the elastomeric component could be considered a portion of the holding member 102. This elastomeric component could be added to a plastic holding member 102 using two-shot molding or overmolding technology or by other methods known or that will be devised in the art.

The material 910 can be formed from any conceivable stretchable or non-stretchable material including, for example, film, foil, cloth, paper, or a polymer material such as linear low-density polyethylene (LLDPE) or polyvinyl chloride (PVC). It is not uncommon for a stretchable material such as these to be stretched between 100% and 500% or more of its original length during use. The film dispenser can be used for any use including, for example and without limitation, any commercial or residential application requiring the wrapping or covering of an item with a material 910 such as the aforementioned stretch wrap film.

One should note that conditional language, such as, among others, "can," "could," "might," or "may," unless specifically stated otherwise, or otherwise understood within the context as used, is generally intended to convey that certain aspects comprise, while other aspects do not comprise, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

That which is claimed is:

1. A film dispenser comprising:

a holding member comprising:

a first end comprising a handle, the handle comprising a plurality of lobes and a plurality of web portions, each web portion extending between a pair of adjacent lobes of the plurality of lobes; and a second end defining a brake portion defined by a slot, the holding member defining a longitudinal axis that extends from the first end to the second end, the slot comprising a first portion extending in a circumferential direction across a full width of the brake portion and two opposing portions extending at an angle from the first portion; and a rotating member, each of the plurality of web portions extending outward beyond an outermost edge of the rotating member relative to the longitudinal axis.

2. The film dispenser of claim 1, wherein each of the plurality of lobes extends outward in a radial direction and is positioned between an outside extremity and an inside extremity of the holding member along a direction of the longitudinal axis.

3. The film dispenser of claim 2, wherein each of the plurality of lobes extends outward beyond an outermost edge of the rotating member relative to the longitudinal axis.

4. The film dispenser of claim 2, wherein the handle comprises four lobes.

5. The film dispenser of claim 1, wherein the web portions together define a round shape.

6. The film dispenser of claim 5, wherein the round shape defined by the web portions is concentric with the longitudinal axis.

7. The film dispenser of claim 1, wherein a center of the brake portion is positioned circumferentially between a pair of adjacent lobes of the plurality of lobes relative to the longitudinal axis.

8. The film dispenser of claim 1, further comprising a connecting portion extending radially inward from the brake portion, wherein the connecting portion is located toward an interior of the holding member along the longitudinal axis and away from an outside extremity of the first end of the holding member, the connecting portion extending in a plane that is angled with respect to the longitudinal axis of the holding member.

9. The film dispenser of claim 8, wherein the holding member further comprises an interior holding surface comprising a concave surface facing the longitudinal axis of the holding member.

10. The film dispenser of claim 1, wherein the holding member further comprises a plurality of stops extending from a one of the first end and the second end and configured to prevent movement of a one of a film roll and a rotating member of the film dispenser past an intersection of the first end and the second end of the holding member.

11. The film dispenser of claim 10, wherein opposing stops of the plurality of stops define a stop diameter, the stop diameter being greater than a one of an inner diameter of the film roll and a diameter of a central hole of the rotating member.

12. A film dispenser comprising:

a holding member comprising:

a first end comprising a handle, the handle comprising a plurality of lobes and a plurality of web portions, each web portion extending between a pair of adjacent lobes of the plurality of lobes;

a second end defining a brake portion defining a slot, the holding member defining a longitudinal axis that extends from the first end to the second end; and a connecting portion extending radially inward from the brake portion; and a rotating member, each of the plurality of web portions extending outward beyond an outermost edge of the rotating member relative to the longitudinal axis.

13. The film dispenser of claim 12, wherein each of the plurality of lobes extends outward in a radial direction relative to the longitudinal axis of the holding member, the plurality of lobes defining an exterior holding surface comprising a handle edge defined by an intersection between the exterior holding surface and an inside extremity of the holding member, a distance in a radial direction from the longitudinal axis of the holding member to the handle edge being greater at a radial centerline of each lobe than at a position between radial centerlines of adjacent lobes.

14. The film dispenser of claim 12, wherein a center of the brake portion is positioned circumferentially between a pair of adjacent lobes of the plurality of lobes relative to the longitudinal axis.

15. The film dispenser of claim 12, wherein a quantity of lobes is equal to a quantity of web portions.

16. The film dispenser of claim 12, wherein the rotating member comprises an annular flange, the web portions together defining a circular edge that is concentric with the longitudinal axis, a diameter of the circular edge substantially equal to or greater than an outer diameter of the annular flange of the rotating member.

17. The film dispenser of claim 12, further comprising a film roll, the film roll comprising a first end and a second end, the first end defining an opening, at least a portion of the holding member positioned inside the opening.

18. A method of dispensing material from a film roll, the method comprising:

holding onto an interior holding surface and an exterior holding surface of a first holding member with a first hand, the first holding member comprising:

a first end comprising the interior holding surface, a plurality of lobes and a plurality of web portions, each web portion extending between a pair of adjacent lobes of the plurality of lobes, the plurality of lobes and the plurality of web portions defining the exterior holding surface; and a second end comprising a brake portion;

wherein the second end of the first holding member is inserted into a first rotating member inserted into an opening defined in the first end of the film roll, each of the plurality of web portions extending outward beyond an outermost edge of the first rotating member relative to a longitudinal axis of the first holding member;

holding onto an interior holding surface and an exterior holding surface of a second holding member with a second hand, the second holding member comprising:

a first end comprising the interior holding surface of the second holding member, a plurality of lobes and a plurality of web portions, each web portion of the second holding member extending between a pair of adjacent lobes of the plurality of lobes of the second holding member, the plurality of lobes of the second holding member and the plurality of web portions of the second holding member defining the exterior holding surface of the second holding member; and a second end comprising a brake portion;

wherein the second end of the second holding member is inserted into a second rotating member inserted into an opening defined in the second end of the film roll, each of the plurality of web portions of the second holding member extending outward beyond an outermost edge of the second rotating member relative to a longitudinal axis of the second holding member;

dispensing the material by rotating the film roll relative to the first holding member and the second holding member; and pressing onto the brake portion of one of the first holding member and the second holding member such that the brake portion brakes movement of the one of the first holding member and the second holding member into the corresponding rotating member to increase tension in or stretch the material being dispensed.

19. The method of claim 18, wherein pressing onto the brake portion of the one of the first holding member and the second holding member comprises contacting the respective rotating member with the brake portion of the one of the first holding member and the second holding member to create friction between the brake portion of the one of the first holding member and the second holding member and the respective rotating member.

20. The method of claim 18, wherein the one of the first holding member and the second holding member further comprises a plurality of stops, the stops preventing movement of a one of the film roll and the respective rotating member past an intersection of the first end and the second end of the one of the first holding member and the second holding member.

* * * * *